US011785380B2

(12) United States Patent
Tian et al.

(10) Patent No.: US 11,785,380 B2
(45) Date of Patent: Oct. 10, 2023

(54) HYBRID AUDIO BEAMFORMING SYSTEM

(71) Applicant: Shure Acquisition Holdings, Inc., Niles, IL (US)

(72) Inventors: Wenshun Tian, Palatine, IL (US); John Casey Gibbs, Chicago, IL (US); Michael Ryan Lester, Colorado Springs, CO (US); Mathew T. Abraham, Colorado Springs, CO (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 17/586,213

(22) Filed: Jan. 27, 2022

(65) Prior Publication Data

US 2022/0240008 A1 Jul. 28, 2022

Related U.S. Application Data

(60) Provisional application No. 63/142,711, filed on Jan. 28, 2021.

(51) Int. Cl.
*H04R 3/00* (2006.01)

(52) U.S. Cl.
CPC ..... *H04R 3/005* (2013.01); *H04R 2201/401* (2013.01)

(58) Field of Classification Search
CPC ..... H04R 3/005; H04R 2201/401; H04R 2201/403; H04R 2201/405; H04R 1/326; H04R 1/406; H04R 29/005; H04R 2430/25; G10K 11/34
USPC ..... 381/56, 58, 91, 92
See application file for complete search history.

(56) References Cited

U.S. PATENT DOCUMENTS

| | | | |
|---|---|---|---|
| 1,535,408 | A | 4/1925 | Fricke |
| 1,540,788 | A | 6/1925 | McClure |
| 1,965,830 | A | 7/1934 | Hammer |
| 2,075,588 | A | 3/1937 | Meyers |
| 2,113,219 | A | 4/1938 | Olson |
| 2,164,655 | A | 7/1939 | Kleerup |
| D122,771 | S | 10/1940 | Doner |
| 2,233,412 | A | 3/1941 | Hill |

(Continued)

FOREIGN PATENT DOCUMENTS

| | | |
|---|---|---|
| CA | 2359771 | 4/2003 |
| CA | 2475283 | 1/2005 |

(Continued)

OTHER PUBLICATIONS

International Search Report and Written Opinion for PCT/US2022/014061 dated May 10, 2022, 14 pp.

(Continued)

*Primary Examiner* — William A Jerez Lora
(74) *Attorney, Agent, or Firm* — NEAL, GERBER & EISENBERG LLP

(57) ABSTRACT

Hybrid audio beamforming systems and methods with narrower beams and improved directivity are provided. The hybrid audio beamforming system includes a time domain beamformer for processing upper frequency band signals of an audio signal using a time domain beamforming technique, and a frequency domain beamformer for processing groups of lower frequency band signals of the audio signal using frequency domain beamforming techniques.

27 Claims, 4 Drawing Sheets

(56) References Cited

U.S. PATENT DOCUMENTS 2,268,529 A 12/1941 Stiles
2,343,037 A 2/1944 Adelman
2,377,449 A 6/1945 Prevette
2,481,250 A 9/1949 Schneider
2,521,603 A 9/1950 Prew
2,533,565 A 12/1950 Eichelman
2,539,671 A 1/1951 Olson
2,777,232 A 1/1957 Kulicke
2,828,508 A 4/1958 Labarre
2,840,181 A 6/1958 Wildman
2,882,633 A 4/1959 Howell
2,912,605 A 11/1959 Tibbetts
2,938,113 A 5/1960 Schnell
2,950,556 A 8/1960 Larios
3,019,854 A 2/1962 Obryant
3,132,713 A 5/1964 Seeler
3,143,182 A 8/1964 Sears
3,160,225 A 12/1964 Sechrist
3,161,975 A 12/1964 McMillan
3,205,601 A 9/1965 Gawne
3,239,973 A 3/1966 Hannes
3,240,883 A 3/1966 Seeler
3,310,901 A 3/1967 Sarkisian
3,321,170 A 5/1967 Vye
3,509,290 A 4/1970 Mochida
3,573,399 A 4/1971 Schroeder
3,657,490 A 4/1972 Scheiber
3,696,885 A 10/1972 Grieg
3,755,625 A 8/1973 Maston
3,828,508 A 8/1974 Moeller
3,857,191 A 12/1974 Sadorus
3,895,194 A 7/1975 Fraim
3,906,431 A 9/1975 Clearwaters
D237,103 S 10/1975 Fisher
3,936,606 A 2/1976 Wanke
3,938,617 A 2/1976 Forbes
3,941,638 A 3/1976 Horky
3,992,584 A 11/1976 Dugan
4,007,461 A 2/1977 Luedtke
4,008,408 A 2/1977 Kodama
4,029,170 A 6/1977 Phillips
4,032,725 A 6/1977 McGee
4,070,547 A 1/1978 Dellar
4,072,821 A 2/1978 Bauer
4,096,353 A 6/1978 Bauer
4,127,156 A 11/1978 Brandt
4,131,760 A 12/1978 Christensen
4,169,219 A 9/1979 Beard
4,184,048 A 1/1980 Alcaide
4,198,705 A 4/1980 Massa
D255,234 S 6/1980 Wellward
D256,015 S 7/1980 Doherty
4,212,133 A 7/1980 Lufkin
4,237,339 A 12/1980 Bunting
4,244,096 A 1/1981 Kashichi
4,244,906 A 1/1981 Heinemann
4,254,417 A 3/1981 Speiser
4,275,694 A 6/1981 Nagaishi
4,296,280 A 10/1981 Richie
4,305,141 A 12/1981 Massa
4,308,425 A 12/1981 Momose
4,311,874 A 1/1982 Wallace, Jr.
4,330,691 A 5/1982 Gordon
4,334,740 A 6/1982 Wray
4,365,449 A 12/1982 Liautaud
4,373,191 A 2/1983 Fette
4,393,631 A 7/1983 Krent
4,414,433 A 11/1983 Horie
4,429,850 A 2/1984 Weber
4,436,966 A 3/1984 Botros
4,449,238 A 5/1984 Lee
4,466,117 A 8/1984 Goerike
4,485,484 A 11/1984 Flanagan
4,489,442 A 12/1984 Anderson
4,518,826 A 5/1985 Caudill
4,521,908 A 6/1985 Miyaji
4,566,557 A 1/1986 Lemaitre
4,593,404 A 6/1986 Bolin
4,594,478 A 6/1986 Gumb
D285,067 S 8/1986 Delbuck
4,625,827 A 12/1986 Bartlett
4,653,102 A 3/1987 Hansen
4,658,425 A 4/1987 Julstrom
4,669,108 A 5/1987 Deinzer
4,675,906 A 6/1987 Sessler
4,693,174 A 9/1987 Anderson
4,696,043 A 9/1987 Iwahara
4,712,231 A 12/1987 Julstrom
4,741,038 A 4/1988 Elko
4,752,961 A 6/1988 Kahn
4,805,730 A 2/1989 O'Neill
4,815,132 A 3/1989 Minami
4,860,366 A 8/1989 Fukushi
4,862,507 A 8/1989 Woodard
4,866,868 A 9/1989 Kass
4,881,135 A 11/1989 Heilweil
4,888,807 A 12/1989 Reichel
4,903,247 A 2/1990 Van Gerwen
4,923,032 A 5/1990 Nuernberger
4,928,312 A 5/1990 Hill
4,969,197 A 11/1990 Takaya
5,000,286 A 3/1991 Crawford
5,038,935 A 8/1991 Wenkman
5,058,170 A 10/1991 Kanamori
5,088,574 A 2/1992 Kertesz, III
D324,780 S 3/1992 Sebesta
5,121,426 A 6/1992 Baumhauer
D329,239 S 9/1992 Hahn
5,189,701 A 2/1993 Jain
5,204,907 A 4/1993 Staple
5,214,709 A 5/1993 Ribic
5,224,170 A * 6/1993 Waite, Jr. ..... H04R 29/006
708/322
D340,718 S 10/1993 Leger
5,289,544 A 2/1994 Franklin
D345,346 S 3/1994 Alfonso
D345,379 S 3/1994 Chan
5,297,210 A 3/1994 Julstrom
5,322,979 A 6/1994 Cassity
5,323,459 A 6/1994 Hirano
5,329,593 A 7/1994 Lazzeroni
5,335,011 A 8/1994 Addeo
5,353,279 A 10/1994 Koyama
5,359,374 A 10/1994 Schwartz
5,371,789 A 12/1994 Hirano
5,383,293 A 1/1995 Royal
5,384,843 A 1/1995 Masuda
5,396,554 A 3/1995 Hirano
5,400,413 A 3/1995 Kindel
D363,045 S 10/1995 Phillips
5,473,701 A 12/1995 Cezanne
5,509,634 A 4/1996 Gebka
5,513,265 A 4/1996 Hirano
5,525,765 A 6/1996 Freiheit
5,550,924 A 8/1996 Helf
5,550,925 A 8/1996 Hori
5,555,447 A 9/1996 Kotzin
5,574,793 A 11/1996 Hirschhorn
5,602,962 A 2/1997 Kellermann
5,633,936 A 5/1997 Oh
5,645,257 A 7/1997 Ward
D382,118 S 8/1997 Ferrero
5,657,393 A 8/1997 Crow
5,661,813 A 8/1997 Shimauchi
5,673,327 A 9/1997 Julstrom
5,687,229 A 11/1997 Sih
5,706,344 A 1/1998 Finn
5,715,319 A 2/1998 Chu
5,717,171 A 2/1998 Miller
D392,977 S 3/1998 Kim
D394,061 S 5/1998 Fink
5,761,318 A 6/1998 Shimauchi
5,766,702 A 6/1998 Lin
5,787,183 A 7/1998 Chu

(56) References Cited

U.S. PATENT DOCUMENTS

| | | | |
|---|---|---|---|
| 5,796,819 | A | 8/1998 | Romesburg |
| 5,848,146 | A | 12/1998 | Slattery |
| 5,870,482 | A | 2/1999 | Loeppert |
| 5,878,147 | A | 3/1999 | Killion |
| 5,888,412 | A | 3/1999 | Sooriakumar |
| 5,888,439 | A | 3/1999 | Miller |
| D416,315 | S | 11/1999 | Nanjo |
| 5,978,211 | A | 11/1999 | Hong |
| 5,991,277 | A | 11/1999 | Maeng |
| 6,035,962 | A | 3/2000 | Lin |
| 6,039,457 | A | 3/2000 | O'Neal |
| 6,041,127 | A | 3/2000 | Elko |
| 6,049,607 | A | 4/2000 | Marash |
| D424,538 | S | 5/2000 | Hayashi |
| 6,069,961 | A | 5/2000 | Nakazawa |
| 6,125,179 | A | 9/2000 | Wu |
| D432,518 | S | 10/2000 | Muto |
| 6,128,395 | A | 10/2000 | De Vries |
| 6,137,887 | A | 10/2000 | Anderson |
| 6,144,746 | A | 11/2000 | Azima |
| 6,151,399 | A | 11/2000 | Killion |
| 6,173,059 | B1 | 1/2001 | Huang |
| 6,198,831 | B1 | 3/2001 | Azima |
| 6,205,224 | B1 | 3/2001 | Underbrink |
| 6,215,881 | B1 | 4/2001 | Azima |
| 6,266,427 | B1 | 7/2001 | Mathur |
| 6,285,770 | B1 | 9/2001 | Azima |
| 6,301,357 | B1 | 10/2001 | Romesburg |
| 6,329,908 | B1 | 12/2001 | Frecska |
| 6,332,029 | B1 | 12/2001 | Azima |
| D453,016 | S | 1/2002 | Nevill |
| 6,386,315 | B1 | 5/2002 | Roy |
| 6,393,129 | B1 | 5/2002 | Conrad |
| 6,424,635 | B1 | 7/2002 | Song |
| 6,442,272 | B1 | 8/2002 | Osovets |
| 6,449,593 | B1 | 9/2002 | Valve |
| 6,481,173 | B1 | 11/2002 | Roy |
| 6,488,367 | B1 | 12/2002 | Debesis |
| D469,090 | S | 1/2003 | Tsuji |
| 6,505,057 | B1 | 1/2003 | Finn |
| 6,507,659 | B1 | 1/2003 | Iredale |
| 6,510,919 | B1 | 1/2003 | Roy |
| 6,526,147 | B1 | 2/2003 | Rung |
| 6,556,682 | B1 | 4/2003 | Gilloire |
| 6,592,237 | B1 | 7/2003 | Pledger |
| 6,622,030 | B1 | 9/2003 | Romesburg |
| D480,923 | S | 10/2003 | Neubourg |
| 6,633,647 | B1 | 10/2003 | Markow |
| 6,665,971 | B2 | 12/2003 | Lowry |
| 6,694,028 | B1 | 2/2004 | Matsuo |
| 6,704,422 | B1 | 3/2004 | Jensen |
| D489,707 | S | 5/2004 | Kobayashi |
| 6,731,334 | B1 | 5/2004 | Maeng |
| 6,741,720 | B1 | 5/2004 | Myatt |
| 6,757,393 | B1 | 6/2004 | Spitzer |
| 6,768,795 | B2 | 7/2004 | Feltstroem |
| 6,868,377 | B1 | 3/2005 | Laroche |
| 6,885,750 | B2 | 4/2005 | Egelmeers |
| 6,885,986 | B1 | 4/2005 | Gigi |
| D504,889 | S | 5/2005 | Andre |
| 6,889,183 | B1 | 5/2005 | Gunduzhan |
| 6,895,093 | B1 | 5/2005 | Ali |
| 6,931,123 | B1 | 8/2005 | Hughes |
| 6,944,312 | B2 | 9/2005 | Mason |
| D510,729 | S | 10/2005 | Chen |
| 6,968,064 | B1 | 11/2005 | Ning |
| 6,990,193 | B2 | 1/2006 | Beaucoup |
| 6,993,126 | B1 | 1/2006 | Kyrylenko |
| 6,993,145 | B2 | 1/2006 | Combest |
| 7,003,099 | B1 | 2/2006 | Zhang |
| 7,013,267 | B1 | 3/2006 | Huart |
| 7,031,269 | B2 | 4/2006 | Lee |
| 7,035,398 | B2 | 4/2006 | Matsuo |
| 7,035,415 | B2 | 4/2006 | Belt |
| 7,050,576 | B2 | 5/2006 | Zhang |
| 7,054,451 | B2 | 5/2006 | Janse |
| D526,643 | S | 8/2006 | Ishizaki |
| D527,372 | S | 8/2006 | Allen |
| 7,092,516 | B2 | 8/2006 | Furuta |
| 7,092,882 | B2 | 8/2006 | Arrowood |
| 7,098,865 | B2 | 8/2006 | Christensen |
| 7,106,876 | B2 | 9/2006 | Santiago |
| 7,120,269 | B2 | 10/2006 | Lowell |
| 7,130,309 | B2 | 10/2006 | Pianka |
| D533,177 | S | 12/2006 | Andre |
| 7,149,320 | B2 | 12/2006 | Haykin |
| 7,161,534 | B2 | 1/2007 | Tsai |
| 7,187,765 | B2 | 3/2007 | Popovic |
| 7,203,308 | B2 | 4/2007 | Kubota |
| D542,543 | S | 5/2007 | Bruce |
| 7,212,628 | B2 | 5/2007 | Popovic |
| D546,318 | S | 7/2007 | Yoon |
| D546,814 | S | 7/2007 | Takita |
| D547,748 | S | 7/2007 | Tsuge |
| 7,239,714 | B2 | 7/2007 | De Blok |
| D549,673 | S | 8/2007 | Niitsu |
| 7,269,263 | B2 | 9/2007 | Dedieu |
| D552,570 | S | 10/2007 | Niitsu |
| D559,553 | S | 1/2008 | Mischel |
| 7,333,476 | B2 | 2/2008 | Leblanc |
| D566,685 | S | 4/2008 | Koller |
| 7,359,504 | B1 | 4/2008 | Reuss |
| 7,366,310 | B2 | 4/2008 | Stinson |
| 7,387,151 | B1 | 6/2008 | Payne |
| 7,412,376 | B2 | 8/2008 | Florencio |
| 7,415,117 | B2 | 8/2008 | Tashev |
| D578,509 | S | 10/2008 | Thomas |
| D581,510 | S | 11/2008 | Albano |
| D582,391 | S | 12/2008 | Morimoto |
| D587,709 | S | 3/2009 | Niitsu |
| D589,605 | S | 3/2009 | Reedy |
| 7,503,616 | B2 | 3/2009 | Linhard |
| 7,515,719 | B2 | 4/2009 | Hooley |
| 7,536,769 | B2 | 5/2009 | Pedersen |
| D595,402 | S | 6/2009 | Miyake |
| D595,736 | S | 7/2009 | Son |
| 7,558,381 | B1 | 7/2009 | Ali |
| 7,565,949 | B2 | 7/2009 | Tojo |
| D601,585 | S | 10/2009 | Andre |
| 7,651,390 | B1 | 1/2010 | Profeta |
| 7,660,428 | B2 | 2/2010 | Rodman |
| 7,667,728 | B2 | 2/2010 | Kenoyer |
| 7,672,445 | B1 | 3/2010 | Zhang |
| D613,338 | S | 4/2010 | Marukos |
| 7,701,110 | B2 | 4/2010 | Fukuda |
| 7,702,116 | B2 | 4/2010 | Stone |
| D614,871 | S | 5/2010 | Tang |
| 7,724,891 | B2 | 5/2010 | Beaucoup |
| D617,441 | S | 6/2010 | Koury |
| 7,747,001 | B2 | 6/2010 | Kellermann |
| 7,756,278 | B2 | 7/2010 | Moorer |
| 7,783,063 | B2 | 8/2010 | Pocino |
| 7,787,328 | B2 | 8/2010 | Chu |
| 7,830,862 | B2 | 11/2010 | James |
| 7,831,035 | B2 | 11/2010 | Stokes |
| 7,831,036 | B2 | 11/2010 | Beaucoup |
| 7,856,097 | B2 | 12/2010 | Tokuda |
| 7,881,486 | B1 | 2/2011 | Killion |
| 7,894,421 | B2 | 2/2011 | Kwan |
| D636,188 | S | 4/2011 | Kim |
| 7,925,006 | B2 | 4/2011 | Hirai |
| 7,925,007 | B2 | 4/2011 | Stokes |
| 7,936,886 | B2 | 5/2011 | Kim |
| 7,970,123 | B2 | 6/2011 | Beaucoup |
| 7,970,151 | B2 | 6/2011 | Oxford |
| D642,385 | S | 8/2011 | Lee |
| D643,015 | S | 8/2011 | Kim |
| 7,991,167 | B2 | 8/2011 | Oxford |
| 7,995,768 | B2 | 8/2011 | Miki |
| 8,000,481 | B2 | 8/2011 | Nishikawa |
| 8,005,238 | B2 | 8/2011 | Tashev |
| 8,019,091 | B2 | 9/2011 | Burnett |
| 8,041,054 | B2 | 10/2011 | Yeldener |
| 8,059,843 | B2 | 11/2011 | Hung |

(56) References Cited

U.S. PATENT DOCUMENTS

| | | | |
|---|---|---|---|
| 8,064,629 | B2 | 11/2011 | Jiang |
| 8,085,947 | B2 | 12/2011 | Haulick |
| 8,085,949 | B2 | 12/2011 | Kim |
| 8,095,120 | B1 | 1/2012 | Blair |
| 8,098,842 | B2 | 1/2012 | Florencio |
| 8,098,844 | B2 | 1/2012 | Elko |
| 8,103,030 | B2 | 1/2012 | Barthel |
| 8,109,360 | B2 | 2/2012 | Stewart, Jr. |
| 8,112,272 | B2 | 2/2012 | Nagahama |
| 8,116,500 | B2 | 2/2012 | Oxford |
| 8,121,834 | B2 | 2/2012 | Rosec |
| D655,271 | S | 3/2012 | Park |
| D656,473 | S | 3/2012 | Laube |
| 8,130,969 | B2 | 3/2012 | Buck |
| 8,130,977 | B2 | 3/2012 | Chu |
| 8,135,143 | B2 | 3/2012 | Ishibashi |
| 8,144,886 | B2 | 3/2012 | Ishibashi |
| D658,153 | S | 4/2012 | Woo |
| 8,155,331 | B2 | 4/2012 | Nakadai |
| 8,170,882 | B2 | 5/2012 | Davis |
| 8,175,291 | B2 | 5/2012 | Chan |
| 8,175,871 | B2 | 5/2012 | Wang |
| 8,184,801 | B1 | 5/2012 | Hamalainen |
| 8,189,765 | B2 | 5/2012 | Nishikawa |
| 8,189,810 | B2 | 5/2012 | Wolff |
| 8,194,863 | B2 | 6/2012 | Takumai |
| 8,199,927 | B1 | 6/2012 | Raftery |
| 8,204,198 | B2 | 6/2012 | Adeney |
| 8,204,248 | B2 | 6/2012 | Haulick |
| 8,208,664 | B2 | 6/2012 | Iwasaki |
| 8,213,596 | B2 | 7/2012 | Beaucoup |
| 8,213,634 | B1 | 7/2012 | Daniel |
| 8,219,387 | B2 | 7/2012 | Cutler |
| 8,229,134 | B2 | 7/2012 | Duraiswami |
| 8,233,352 | B2 | 7/2012 | Beaucoup |
| 8,243,951 | B2 | 8/2012 | Ishibashi |
| 8,244,536 | B2 | 8/2012 | Arun |
| 8,249,273 | B2 | 8/2012 | Inoda |
| 8,259,959 | B2 | 9/2012 | Marton |
| 8,275,120 | B2 | 9/2012 | Stokes, III |
| 8,280,728 | B2 | 10/2012 | Chen |
| 8,284,949 | B2 | 10/2012 | Farhang |
| 8,284,952 | B2 | 10/2012 | Reining |
| 8,286,749 | B2 | 10/2012 | Stewart |
| 8,290,142 | B1 | 10/2012 | Lambert |
| 8,291,670 | B2 | 10/2012 | Gard |
| 8,297,402 | B2 | 10/2012 | Stewart |
| 8,315,380 | B2 | 11/2012 | Liu |
| 8,331,582 | B2 | 12/2012 | Steele |
| 8,345,898 | B2 | 1/2013 | Reining |
| 8,355,521 | B2 | 1/2013 | Larson |
| 8,370,140 | B2 | 2/2013 | Vitte |
| 8,379,823 | B2 | 2/2013 | Ratmanski |
| 8,385,557 | B2 | 2/2013 | Tashev |
| D678,329 | S | 3/2013 | Lee |
| 8,395,653 | B2 | 3/2013 | Feng |
| 8,403,107 | B2 | 3/2013 | Stewart |
| 8,406,436 | B2 | 3/2013 | Craven |
| 8,428,661 | B2 | 4/2013 | Chen |
| 8,433,061 | B2 | 4/2013 | Cutler |
| D682,266 | S | 5/2013 | Wu |
| 8,437,490 | B2 | 5/2013 | Marton |
| 8,443,930 | B2 | 5/2013 | Stewart, Jr. |
| 8,447,590 | B2 | 5/2013 | Ishibashi |
| 8,472,639 | B2 | 6/2013 | Reining |
| 8,472,640 | B2 | 6/2013 | Marton |
| D685,346 | S | 7/2013 | Szymanski |
| D686,182 | S | 7/2013 | Ashiwa |
| 8,479,871 | B2 | 7/2013 | Stewart |
| 8,483,398 | B2 | 7/2013 | Fozunbal |
| 8,498,423 | B2 | 7/2013 | Thaden |
| D687,432 | S | 8/2013 | Duan |
| 8,503,653 | B2 | 8/2013 | Ahuja |
| 8,515,089 | B2 | 8/2013 | Nicholson |
| 8,515,109 | B2 | 8/2013 | Dittberner |
| 8,526,633 | B2 | 9/2013 | Ukai |
| 8,553,904 | B2 | 10/2013 | Said |
| 8,559,611 | B2 | 10/2013 | Ratmanski |
| D693,328 | S | 11/2013 | Goetzen |
| 8,583,481 | B2 | 11/2013 | Viveiros |
| 8,599,194 | B2 | 12/2013 | Lewis |
| 8,600,443 | B2 | 12/2013 | Kawaguchi |
| 8,605,890 | B2 | 12/2013 | Zhang |
| 8,620,650 | B2 | 12/2013 | Walters |
| 8,631,897 | B2 | 1/2014 | Stewart |
| 8,634,569 | B2 | 1/2014 | Lu |
| 8,638,951 | B2 | 1/2014 | Zurek |
| D699,712 | S | 2/2014 | Bourne |
| 8,644,477 | B2 | 2/2014 | Gilbert |
| 8,654,955 | B1 | 2/2014 | Lambert |
| 8,654,990 | B2 | 2/2014 | Faller |
| 8,660,274 | B2 | 2/2014 | Wolff |
| 8,660,275 | B2 | 2/2014 | Buck |
| 8,670,581 | B2 | 3/2014 | Harman |
| 8,672,087 | B2 | 3/2014 | Stewart |
| 8,675,890 | B2 | 3/2014 | Schmidt |
| 8,675,899 | B2 | 3/2014 | Jung |
| 8,676,728 | B1 | 3/2014 | Velusamy |
| 8,682,675 | B2 | 3/2014 | Togami |
| 8,724,829 | B2 | 5/2014 | Visser |
| 8,730,156 | B2 | 5/2014 | Weising |
| 8,744,069 | B2 | 6/2014 | Cutler |
| 8,744,101 | B1 | 6/2014 | Burns |
| 8,755,536 | B2 | 6/2014 | Chen |
| 8,811,601 | B2 | 8/2014 | Mohammad |
| 8,818,002 | B2 | 8/2014 | Tashev |
| 8,824,693 | B2 | 9/2014 | Åhgren |
| 8,842,851 | B2 | 9/2014 | Beaucoup |
| 8,855,326 | B2 | 10/2014 | Derkx |
| 8,855,327 | B2 | 10/2014 | Tanaka |
| 8,861,713 | B2 | 10/2014 | Xu |
| 8,861,756 | B2 | 10/2014 | Zhu |
| 8,873,789 | B2 | 10/2014 | Bigeh |
| D717,272 | S | 11/2014 | Kim |
| 8,886,343 | B2 | 11/2014 | Ishibashi |
| 8,893,849 | B2 | 11/2014 | Hudson |
| 8,898,633 | B2 | 11/2014 | Bryant |
| D718,731 | S | 12/2014 | Lee |
| 8,903,106 | B2 | 12/2014 | Meyer |
| 8,923,529 | B2 | 12/2014 | McCowan |
| 8,929,564 | B2 | 1/2015 | Kikkeri |
| 8,942,382 | B2 | 1/2015 | Elko |
| 8,965,546 | B2 | 2/2015 | Visser |
| D725,059 | S | 3/2015 | Kim |
| D725,631 | S | 3/2015 | McNamara |
| 8,976,977 | B2 | 3/2015 | De |
| 8,983,089 | B1 | 3/2015 | Chu |
| 8,983,834 | B2 | 3/2015 | Davis |
| D726,144 | S | 4/2015 | Kang |
| D727,968 | S | 4/2015 | Onoue |
| 9,002,028 | B2 | 4/2015 | Haulick |
| D729,767 | S | 5/2015 | Lee |
| 9,038,301 | B2 | 5/2015 | Zelbacher |
| 9,088,336 | B2 | 7/2015 | Mani |
| 9,094,496 | B2 | 7/2015 | Teutsch |
| D735,717 | S | 8/2015 | Lam |
| D737,245 | S | 8/2015 | Fan |
| 9,099,094 | B2 | 8/2015 | Burnett |
| 9,107,001 | B2 | 8/2015 | Diethorn |
| 9,111,543 | B2 | 8/2015 | Åhgren |
| 9,113,242 | B2 | 8/2015 | Hyun |
| 9,113,247 | B2 | 8/2015 | Chatlani |
| 9,126,827 | B2 | 9/2015 | Hsieh |
| 9,129,223 | B1 | 9/2015 | Velusamy |
| 9,140,054 | B2 | 9/2015 | Oberbroeckling |
| D740,279 | S | 10/2015 | Wu |
| 9,172,345 | B2 | 10/2015 | Kok |
| D743,376 | S | 11/2015 | Kim |
| D743,939 | S | 11/2015 | Seong |
| 9,196,261 | B2 | 11/2015 | Burnett |
| 9,197,974 | B1 | 11/2015 | Clark |
| 9,203,494 | B2 | 12/2015 | Tarighat Mehrabani |
| 9,215,327 | B2 | 12/2015 | Bathurst |
| 9,215,543 | B2 | 12/2015 | Sun |

(56) References Cited

U.S. PATENT DOCUMENTS 9,226,062 B2 12/2015 Sun
9,226,070 B2 12/2015 Hyun
9,226,088 B2 12/2015 Pandey
9,232,185 B2 1/2016 Graham
9,237,391 B2 1/2016 Benesty
9,247,367 B2 1/2016 Nobile
9,253,567 B2 2/2016 Morcelli
9,257,132 B2 2/2016 Gowreesunker
9,264,553 B2 2/2016 Pandey
9,264,805 B2 2/2016 Buck
9,280,985 B2 3/2016 Tawada
9,286,908 B2 3/2016 Zhang
9,294,839 B2 3/2016 Lambert
9,301,049 B2 3/2016 Elko
D754,103 S 4/2016 Fischer
9,307,326 B2 4/2016 Elko
9,319,532 B2 4/2016 Bao
9,319,799 B2 4/2016 Salmon
9,326,060 B2 4/2016 Nicholson
D756,502 S 5/2016 Lee
9,330,673 B2 5/2016 Cho
9,338,301 B2 5/2016 Pocino
9,338,549 B2 5/2016 Haulick
9,354,310 B2 5/2016 Visser
9,357,080 B2 5/2016 Beaucoup
9,403,670 B2 8/2016 Schelling
9,426,598 B2 8/2016 Walsh
D767,748 S 9/2016 Nakai
9,451,078 B2 9/2016 Yang
D769,239 S 10/2016 Li
9,462,378 B2 10/2016 Kuech
9,473,868 B2 10/2016 Huang
9,479,627 B1 10/2016 Rung
9,479,885 B1 10/2016 Ivanov
9,489,948 B1 11/2016 Chu
9,510,090 B2 11/2016 Lissek
9,514,723 B2 12/2016 Silfvast
9,516,412 B2 12/2016 Shigenaga
9,521,057 B2 12/2016 Klingbeil
9,549,245 B2 1/2017 Frater
9,560,446 B1 1/2017 Chang
9,560,451 B2 1/2017 Eichfeld
9,565,493 B2 2/2017 Abraham
9,578,413 B2 2/2017 Sawa
9,578,440 B2 2/2017 Otto
9,589,556 B2 3/2017 Gao
9,591,123 B2 3/2017 Sorensen
9,591,404 B1 3/2017 Chhetri
D784,299 S 4/2017 Cho
9,615,173 B2 4/2017 Sako
9,628,596 B1 4/2017 Bullough
9,635,186 B2 4/2017 Pandey
9,635,474 B2 4/2017 Kuster
D787,481 S 5/2017 Tyss
D788,073 S 5/2017 Silvera
9,640,187 B2 5/2017 Niemisto
9,641,688 B2 5/2017 Pandey
9,641,929 B2 5/2017 Li
9,641,935 B1 5/2017 Ivanov
9,653,091 B2 5/2017 Matsuo
9,653,092 B2 5/2017 Sun
9,655,001 B2 5/2017 Metzger
9,659,576 B1 5/2017 Kotvis
D789,323 S 6/2017 MacKiewicz
9,674,604 B2 6/2017 Deroo
9,692,882 B2 6/2017 Mani
9,706,057 B2 7/2017 Mani
9,716,944 B2 7/2017 Yliaho
9,721,582 B1 8/2017 Huang
9,734,835 B2 8/2017 Fujieda
9,754,572 B2 9/2017 Salazar
9,761,243 B2 9/2017 Taenzer
D801,285 S 10/2017 Timmins
9,788,119 B2 10/2017 Vilermo
9,813,806 B2 11/2017 Graham
9,818,426 B2 11/2017 Kotera
9,826,211 B2 11/2017 Sawa
9,854,101 B2 12/2017 Pandey
9,854,363 B2 12/2017 Sladeczek
9,860,439 B2 1/2018 Sawa
9,866,952 B2 1/2018 Pandey
D811,393 S 2/2018 Ahn
9,894,434 B2 2/2018 Rollow, IV
9,930,448 B1 3/2018 Chen
9,936,290 B2 4/2018 Mohammad
9,966,059 B1 5/2018 Ayrapetian
9,973,848 B2 5/2018 Chhetri
9,980,042 B1 5/2018 Benattar
D819,607 S 6/2018 Chui
D819,631 S 6/2018 Matsumiya
10,015,589 B1 7/2018 Ebenezer
10,021,506 B2 7/2018 Johnson
10,021,515 B1 7/2018 Mallya
10,034,116 B2 7/2018 Kadri
10,054,320 B2 8/2018 Choi
10,153,744 B1 12/2018 Every
10,165,386 B2 12/2018 Lehtiniemi
D841,589 S 2/2019 Böhmer
10,206,030 B2 2/2019 Matsumoto
10,210,882 B1 2/2019 McCowan
10,231,062 B2 3/2019 Pedersen
10,244,121 B2 3/2019 Mani
10,244,219 B2 3/2019 Sawa
10,269,343 B2 4/2019 Wingate
10,367,948 B2 7/2019 Wells-Rutherford
D857,873 S 8/2019 Shimada
10,389,861 B2 8/2019 Mani
10,389,885 B2 8/2019 Sun
D860,319 S 9/2019 Beruto
D860,997 S 9/2019 Jhun
D864,136 S 10/2019 Kim
10,440,469 B2 10/2019 Barnett
D865,723 S 11/2019 Cho
10,566,008 B2 2/2020 Thorpe
10,602,267 B2 3/2020 Grosche
D883,952 S 5/2020 Lucas
10,650,797 B2 5/2020 Kumar
D888,020 S 6/2020 Lyu
10,728,653 B2 7/2020 Graham
D900,070 S 10/2020 Lantz
D900,071 S 10/2020 Lantz
D900,072 S 10/2020 Lantz
D900,073 S 10/2020 Lantz
D900,074 S 10/2020 Lantz
10,827,263 B2 11/2020 Christoph
10,863,270 B1 12/2020 Cornelius
10,930,297 B2 2/2021 Christoph
10,959,018 B1 3/2021 Shi
10,979,805 B2 4/2021 Chowdhary
D924,189 S 7/2021 Park
11,109,133 B2 8/2021 Lantz
D940,116 S 1/2022 Cho
11,218,802 B1 * 1/2022 Kandadai ..... G06F 3/165
2001/0031058 A1 10/2001 Anderson
2002/0015500 A1 2/2002 Belt
2002/0041679 A1 4/2002 Beaucoup
2002/0048377 A1 4/2002 Vaudrey
2002/0064158 A1 5/2002 Yokoyama
2002/0064287 A1 5/2002 Kawamura
2002/0069054 A1 6/2002 Arrowood
2002/0110255 A1 8/2002 Killion
2002/0126861 A1 9/2002 Colby
2002/0131580 A1 9/2002 Smith
2002/0140633 A1 10/2002 Rafii
2002/0146282 A1 10/2002 Wilkes
2002/0149070 A1 10/2002 Sheplak
2002/0159603 A1 10/2002 Hirai
2003/0026437 A1 2/2003 Janse
2003/0053639 A1 3/2003 Beaucoup
2003/0059061 A1 3/2003 Tsuji
2003/0063762 A1 4/2003 Tajima
2003/0063768 A1 4/2003 Cornelius
2003/0072461 A1 4/2003 Moorer
2003/0107478 A1 6/2003 Hendricks

(56) References Cited

U.S. PATENT DOCUMENTS

| | | | |
|---|---|---|---|
| 2003/0118200 | A1 | 6/2003 | Beaucoup |
| 2003/0122777 | A1 | 7/2003 | Grover |
| 2003/0138119 | A1 | 7/2003 | Pocino |
| 2003/0156725 | A1 | 8/2003 | Boone |
| 2003/0161485 | A1 | 8/2003 | Smith |
| 2003/0163326 | A1 | 8/2003 | Maase |
| 2003/0169888 | A1 | 9/2003 | Subotic |
| 2003/0185404 | A1 | 10/2003 | Milsap |
| 2003/0198339 | A1 | 10/2003 | Roy |
| 2003/0198359 | A1 | 10/2003 | Killion |
| 2003/0202107 | A1 | 10/2003 | Slattery |
| 2004/0013038 | A1 | 1/2004 | Kajala |
| 2004/0013252 | A1 | 1/2004 | Craner |
| 2004/0076305 | A1 | 4/2004 | Santiago |
| 2004/0105557 | A1 | 6/2004 | Matsuo |
| 2004/0125942 | A1 | 7/2004 | Beaucoup |
| 2004/0175006 | A1 | 9/2004 | Kim |
| 2004/0202345 | A1 | 10/2004 | Stenberg |
| 2004/0240664 | A1 | 12/2004 | Freed |
| 2005/0005494 | A1 | 1/2005 | Way |
| 2005/0041530 | A1 | 2/2005 | Goudie |
| 2005/0069156 | A1 | 3/2005 | Haapapuro |
| 2005/0094580 | A1 | 5/2005 | Kumar |
| 2005/0094795 | A1 | 5/2005 | Rambo |
| 2005/0149320 | A1 | 7/2005 | Kajala |
| 2005/0157897 | A1 | 7/2005 | Saltykov |
| 2005/0175189 | A1 | 8/2005 | Lee |
| 2005/0175190 | A1 | 8/2005 | Tashev |
| 2005/0213747 | A1 | 9/2005 | Popovich |
| 2005/0221867 | A1 | 10/2005 | Zurek |
| 2005/0238196 | A1 | 10/2005 | Furuno |
| 2005/0270906 | A1 | 12/2005 | Ramenzoni |
| 2005/0271221 | A1 | 12/2005 | Cerwin |
| 2005/0286698 | A1 | 12/2005 | Bathurst |
| 2005/0286729 | A1 | 12/2005 | Harwood |
| 2006/0083390 | A1 | 4/2006 | Kaderavek |
| 2006/0088173 | A1 | 4/2006 | Rodman |
| 2006/0093128 | A1 | 5/2006 | Oxford |
| 2006/0098403 | A1 | 5/2006 | Smith |
| 2006/0104458 | A1 | 5/2006 | Kenoyer |
| 2006/0109983 | A1 | 5/2006 | Young |
| 2006/0151256 | A1 | 7/2006 | Lee |
| 2006/0159293 | A1 | 7/2006 | Azima |
| 2006/0161430 | A1 | 7/2006 | Schweng |
| 2006/0165242 | A1 | 7/2006 | Miki |
| 2006/0192976 | A1 | 8/2006 | Hall |
| 2006/0198541 | A1 | 9/2006 | Henry |
| 2006/0204022 | A1 | 9/2006 | Hooley |
| 2006/0215866 | A1 | 9/2006 | Francisco |
| 2006/0222187 | A1 | 10/2006 | Jarrett |
| 2006/0233353 | A1 | 10/2006 | Beaucoup |
| 2006/0239471 | A1 | 10/2006 | Mao |
| 2006/0262942 | A1 | 11/2006 | Oxford |
| 2006/0269080 | A1 | 11/2006 | Oxford |
| 2006/0269086 | A1 | 11/2006 | Page |
| 2007/0006474 | A1 | 1/2007 | Taniguchi |
| 2007/0009116 | A1 | 1/2007 | Reining |
| 2007/0019828 | A1 | 1/2007 | Hughes |
| 2007/0053524 | A1 | 3/2007 | Haulick |
| 2007/0093714 | A1 | 4/2007 | Beaucoup |
| 2007/0116255 | A1 | 5/2007 | Derkx |
| 2007/0120029 | A1 | 5/2007 | Keung |
| 2007/0165871 | A1 | 7/2007 | Roovers |
| 2007/0230712 | A1 | 10/2007 | Belt |
| 2007/0253561 | A1 | 11/2007 | Williams |
| 2007/0269066 | A1 | 11/2007 | Derleth |
| 2008/0008339 | A1 | 1/2008 | Ryan |
| 2008/0033723 | A1 | 2/2008 | Jang |
| 2008/0046235 | A1 | 2/2008 | Chen |
| 2008/0056517 | A1 | 3/2008 | Algazi |
| 2008/0101622 | A1 | 5/2008 | Sugiyama |
| 2008/0130907 | A1 | 6/2008 | Sudo |
| 2008/0144848 | A1 | 6/2008 | Buck |
| 2008/0168283 | A1 | 7/2008 | Penning |
| 2008/0188965 | A1 | 8/2008 | Bruey |
| 2008/0212805 | A1 | 9/2008 | Fincham |
| 2008/0232607 | A1 | 9/2008 | Tashev |
| 2008/0247567 | A1 | 10/2008 | Kjolerbakken |
| 2008/0253553 | A1 | 10/2008 | Li |
| 2008/0253589 | A1 | 10/2008 | Trahms |
| 2008/0259731 | A1 | 10/2008 | Happonen |
| 2008/0260175 | A1 | 10/2008 | Elko |
| 2008/0279400 | A1 | 11/2008 | Knoll |
| 2008/0285772 | A1 | 11/2008 | Haulick |
| 2009/0003586 | A1 | 1/2009 | Lai |
| 2009/0030536 | A1 | 1/2009 | Gur |
| 2009/0052684 | A1 | 2/2009 | Ishibashi |
| 2009/0086998 | A1 | 4/2009 | Jeong |
| 2009/0087000 | A1 | 4/2009 | Ko |
| 2009/0087001 | A1 | 4/2009 | Jiang |
| 2009/0094817 | A1 | 4/2009 | Killion |
| 2009/0129609 | A1 | 5/2009 | Oh |
| 2009/0147967 | A1 | 6/2009 | Ishibashi |
| 2009/0150149 | A1 | 6/2009 | Cutter |
| 2009/0161880 | A1 | 6/2009 | Hooley |
| 2009/0169027 | A1 | 7/2009 | Ura |
| 2009/0173030 | A1 | 7/2009 | Gulbrandsen |
| 2009/0173570 | A1 | 7/2009 | Levit |
| 2009/0226004 | A1 | 9/2009 | Soerensen |
| 2009/0233545 | A1 | 9/2009 | Sutskover |
| 2009/0237561 | A1 | 9/2009 | Kobayashi |
| 2009/0254340 | A1 | 10/2009 | Sun |
| 2009/0274318 | A1 | 11/2009 | Ishibashi |
| 2009/0310794 | A1 | 12/2009 | Ishibashi |
| 2010/0011644 | A1 | 1/2010 | Kramer |
| 2010/0034397 | A1 | 2/2010 | Nakadai |
| 2010/0074433 | A1 | 3/2010 | Zhang |
| 2010/0111323 | A1 | 5/2010 | Marton |
| 2010/0111324 | A1 | 5/2010 | Yeldener |
| 2010/0119097 | A1 | 5/2010 | Ohtsuka |
| 2010/0123785 | A1 | 5/2010 | Chen |
| 2010/0128892 | A1 | 5/2010 | Chen |
| 2010/0128901 | A1 | 5/2010 | Herman |
| 2010/0131749 | A1 | 5/2010 | Kim |
| 2010/0142721 | A1 | 6/2010 | Wada |
| 2010/0150364 | A1 | 6/2010 | Buck |
| 2010/0158268 | A1 | 6/2010 | Marton |
| 2010/0165071 | A1 | 7/2010 | Ishibashi |
| 2010/0166219 | A1 | 7/2010 | Marton |
| 2010/0189275 | A1 | 7/2010 | Christoph |
| 2010/0189299 | A1 | 7/2010 | Grant |
| 2010/0202628 | A1 | 8/2010 | Meyer |
| 2010/0208605 | A1 | 8/2010 | Wang |
| 2010/0215184 | A1 | 8/2010 | Buck |
| 2010/0215189 | A1 | 8/2010 | Marton |
| 2010/0217590 | A1 | 8/2010 | Nemer |
| 2010/0245624 | A1 | 9/2010 | Beaucoup |
| 2010/0246873 | A1 | 9/2010 | Chen |
| 2010/0284185 | A1 | 11/2010 | Ngai |
| 2010/0305728 | A1 | 12/2010 | Aiso |
| 2010/0314513 | A1 | 12/2010 | Evans |
| 2011/0002469 | A1 | 1/2011 | Ojala |
| 2011/0007921 | A1 | 1/2011 | Stewart |
| 2011/0033063 | A1 | 2/2011 | McGrath |
| 2011/0038229 | A1 | 2/2011 | Beaucoup |
| 2011/0096136 | A1 | 4/2011 | Liu |
| 2011/0096631 | A1 | 4/2011 | Kondo |
| 2011/0096915 | A1 | 4/2011 | Nemer |
| 2011/0164761 | A1 | 7/2011 | McCowan |
| 2011/0194719 | A1 | 8/2011 | Frater |
| 2011/0211706 | A1 | 9/2011 | Tanaka |
| 2011/0235821 | A1 | 9/2011 | Okita |
| 2011/0268287 | A1 | 11/2011 | Ishibashi |
| 2011/0311064 | A1 | 12/2011 | Teutsch |
| 2011/0311085 | A1 | 12/2011 | Stewart |
| 2011/0317862 | A1 | 12/2011 | Hosoe |
| 2012/0002835 | A1 | 1/2012 | Stewart |
| 2012/0014049 | A1 | 1/2012 | Ogle |
| 2012/0027227 | A1 | 2/2012 | Kok |
| 2012/0070015 | A1 | 3/2012 | Oh |
| 2012/0076316 | A1 | 3/2012 | Zhu |
| 2012/0080260 | A1 | 4/2012 | Stewart |
| 2012/0093344 | A1 | 4/2012 | Sun |
| 2012/0117474 | A1 | 5/2012 | Miki |

(56) References Cited

U.S. PATENT DOCUMENTS

2012/0128160 A1 5/2012 Kim
2012/0128175 A1 5/2012 Visser
2012/0155688 A1 6/2012 Wilson
2012/0155703 A1 6/2012 Hernandez-Abrego
2012/0163625 A1 6/2012 Siotis
2012/0169826 A1 7/2012 Jeong
2012/0177219 A1 7/2012 Mullen
2012/0182429 A1 7/2012 Forutanpour
2012/0207335 A1 8/2012 Spaanderman
2012/0224709 A1 9/2012 Keddem
2012/0243698 A1 9/2012 Elko
2012/0262536 A1 10/2012 Chen
2012/0288079 A1 11/2012 Burnett
2012/0288114 A1 11/2012 Duraiswami
2012/0294472 A1 11/2012 Hudson
2012/0327115 A1 12/2012 Chhetri
2012/0328142 A1 12/2012 Horibe
2013/0002797 A1 1/2013 Thapa
2013/0004013 A1 1/2013 Stewart
2013/0015014 A1 1/2013 Stewart
2013/0016847 A1 1/2013 Steiner
2013/0028451 A1 1/2013 De Roo
2013/0029684 A1 1/2013 Kawaguchi
2013/0034241 A1 2/2013 Pandey
2013/0039504 A1 2/2013 Pandey
2013/0083911 A1 4/2013 Bathurst
2013/0094689 A1 4/2013 Tanaka
2013/0101141 A1 4/2013 McElveen
2013/0136274 A1 5/2013 Aehgren
2013/0142343 A1 6/2013 Matsui
2013/0147835 A1 6/2013 Lee
2013/0156198 A1 6/2013 Kim
2013/0182190 A1 7/2013 McCartney
2013/0206501 A1 8/2013 Yu
2013/0216066 A1 8/2013 Yerrace
2013/0226593 A1 8/2013 Magnusson
2013/0251181 A1 9/2013 Stewart
2013/0264144 A1 10/2013 Hudson
2013/0271559 A1 10/2013 Feng
2013/0294616 A1 11/2013 Mulder
2013/0297302 A1 11/2013 Pan
2013/0304476 A1 11/2013 Kim
2013/0304479 A1 11/2013 Teller
2013/0329908 A1 12/2013 Lindahl
2013/0332156 A1 12/2013 Tackin
2013/0336516 A1 12/2013 Stewart
2013/0343549 A1 12/2013 Vemireddy
2014/0003635 A1 1/2014 Mohammad
2014/0010383 A1 1/2014 MacKey
2014/0016794 A1 1/2014 Lu
2014/0029761 A1 1/2014 Maenpaa
2014/0037097 A1 2/2014 Mark
2014/0050332 A1 2/2014 Nielsen
2014/0072151 A1 3/2014 Ochs
2014/0098233 A1 4/2014 Martin
2014/0098964 A1 4/2014 Rosca
2014/0122060 A1 5/2014 Kaszczuk
2014/0177857 A1 6/2014 Kuster
2014/0233777 A1 8/2014 Tseng
2014/0233778 A1 8/2014 Hardiman
2014/0264654 A1 9/2014 Salmon
2014/0265774 A1 9/2014 Stewart
2014/0270271 A1 9/2014 Dehe
2014/0286518 A1 9/2014 Stewart
2014/0295768 A1 10/2014 Wu
2014/0301586 A1 10/2014 Stewart
2014/0307882 A1 10/2014 Leblanc
2014/0314251 A1 10/2014 Rosca
2014/0341392 A1 11/2014 Lambert
2014/0357177 A1 12/2014 Stewart
2014/0363008 A1 12/2014 Chen
2015/0003638 A1 1/2015 Kasai
2015/0025878 A1 1/2015 Gowreesunker
2015/0030172 A1 1/2015 Gaensler
2015/0033042 A1 1/2015 Iwamoto
2015/0050967 A1 2/2015 Bao
2015/0055796 A1 2/2015 Nugent
2015/0055797 A1 2/2015 Nguyen
2015/0063579 A1 3/2015 Bao
2015/0070188 A1 3/2015 Aramburu
2015/0078581 A1 3/2015 Etter
2015/0078582 A1 3/2015 Graham
2015/0097719 A1 4/2015 Balachandreswaran
2015/0104023 A1 4/2015 Bilobrov
2015/0117672 A1 4/2015 Christoph
2015/0118960 A1 4/2015 Petit
2015/0126255 A1 5/2015 Yang
2015/0156578 A1 6/2015 Alexandridis
2015/0163577 A1 6/2015 Benesty
2015/0185825 A1 7/2015 Mullins
2015/0189423 A1 7/2015 Giannuzzi
2015/0208171 A1 7/2015 Funakoshi
2015/0237424 A1 8/2015 Wilker
2015/0281832 A1 10/2015 Kishimoto
2015/0281833 A1 10/2015 Shigenaga
2015/0281834 A1 10/2015 Takano
2015/0312662 A1 10/2015 Kishimoto
2015/0312691 A1 10/2015 Virolainen
2015/0326968 A1 11/2015 Shigenaga
2015/0341734 A1 11/2015 Sherman
2015/0350621 A1 12/2015 Sawa
2015/0358734 A1 12/2015 Butler
2016/0011851 A1 1/2016 Zhang
2016/0021478 A1 1/2016 Katagiri
2016/0029120 A1 1/2016 Nesta
2016/0031700 A1 2/2016 Sparks
2016/0037277 A1 2/2016 Matsumoto
2016/0055859 A1 2/2016 Finlow-Bates
2016/0080867 A1 3/2016 Nugent
2016/0088392 A1 3/2016 Huttunen
2016/0100092 A1 4/2016 Bohac
2016/0105473 A1 4/2016 Klingbeil
2016/0111109 A1 4/2016 Tsujikawa
2016/0127527 A1 5/2016 Mani
2016/0134928 A1 5/2016 Ogle
2016/0142548 A1 5/2016 Pandey
2016/0142814 A1 5/2016 Deroo
2016/0142815 A1 5/2016 Norris
2016/0148057 A1 5/2016 Oh
2016/0150315 A1 5/2016 Tzirkel-Hancock
2016/0150316 A1 5/2016 Kubota
2016/0155455 A1 6/2016 Ojanperä
2016/0165340 A1 6/2016 Benattar
2016/0173976 A1 6/2016 Podhradsky
2016/0173978 A1 6/2016 Li
2016/0189727 A1 6/2016 Wu
2016/0192068 A1 6/2016 Ng
2016/0196836 A1 7/2016 Yu
2016/0234593 A1 8/2016 Matsumoto
2016/0275961 A1 9/2016 Yu
2016/0295279 A1 10/2016 Srinivasan
2016/0300584 A1 10/2016 Pandey
2016/0302002 A1 10/2016 Lambert
2016/0302006 A1 10/2016 Pandey
2016/0323667 A1 11/2016 Shumard
2016/0323668 A1 11/2016 Abraham
2016/0330545 A1 11/2016 McElveen
2016/0337523 A1 11/2016 Pandey
2016/0353200 A1 12/2016 Bigeh
2016/0357508 A1 12/2016 Moore
2017/0019744 A1 1/2017 Matsumoto
2017/0064451 A1 3/2017 Park
2017/0105066 A1 4/2017 McLaughlin
2017/0134849 A1 5/2017 Pandey
2017/0134850 A1 5/2017 Graham
2017/0164101 A1 6/2017 Rollow, IV
2017/0180861 A1 6/2017 Chen
2017/0206064 A1 7/2017 Breazeal
2017/0230748 A1 8/2017 Shumard
2017/0264999 A1 9/2017 Fukuda
2017/0303887 A1 10/2017 Richmond
2017/0308352 A1 10/2017 Kessler
2017/0374454 A1 12/2017 Bernardini
2018/0083848 A1 3/2018 Siddiqi

(56) References Cited

U.S. PATENT DOCUMENTS

| | | | | |
|---|---|---|---|---|
| 2018/0102136 | A1 | 4/2018 | Ebenezer | |
| 2018/0109873 | A1 | 4/2018 | Xiang | |
| 2018/0115799 | A1 | 4/2018 | Thiele | |
| 2018/0160224 | A1 | 6/2018 | Graham | |
| 2018/0196585 | A1 | 7/2018 | Densham | |
| 2018/0219922 | A1 | 8/2018 | Bryans | |
| 2018/0227666 | A1 | 8/2018 | Barnett | |
| 2018/0292079 | A1 | 10/2018 | Branham | |
| 2018/0310096 | A1 | 10/2018 | Shumard | |
| 2018/0313558 | A1 | 11/2018 | Byers | |
| 2018/0338205 | A1 | 11/2018 | Abraham | |
| 2018/0359565 | A1 | 12/2018 | Kim | |
| 2019/0042187 | A1 | 2/2019 | Truong | |
| 2019/0166424 | A1 | 5/2019 | Harney | |
| 2019/0182607 | A1* | 6/2019 | Pedersen | H04R 25/407 |
| 2019/0215540 | A1 | 7/2019 | Nicol | |
| 2019/0230436 | A1 | 7/2019 | Tsingos | |
| 2019/0259408 | A1 | 8/2019 | Freeman | |
| 2019/0268683 | A1 | 8/2019 | Miyahara | |
| 2019/0295540 | A1 | 9/2019 | Grima | |
| 2019/0295569 | A1 | 9/2019 | Wang | |
| 2019/0319677 | A1 | 10/2019 | Hansen | |
| 2019/0371354 | A1 | 12/2019 | Lester | |
| 2019/0373362 | A1 | 12/2019 | Ansai | |
| 2019/0385629 | A1 | 12/2019 | Moravy | |
| 2019/0387311 | A1* | 12/2019 | Schultz | H04R 1/406 |
| 2020/0015021 | A1 | 1/2020 | Leppanen | |
| 2020/0021910 | A1 | 1/2020 | Rollow, IV | |
| 2020/0027472 | A1 | 1/2020 | Huang | |
| 2020/0037068 | A1 | 1/2020 | Barnett | |
| 2020/0068297 | A1 | 2/2020 | Rollow, IV | |
| 2020/0100009 | A1 | 3/2020 | Lantz | |
| 2020/0100025 | A1 | 3/2020 | Shumard | |
| 2020/0107137 | A1* | 4/2020 | Koutrouli | H04R 25/407 |
| 2020/0137485 | A1 | 4/2020 | Yamakawa | |
| 2020/0145753 | A1 | 5/2020 | Rollow, IV | |
| 2020/0152218 | A1 | 5/2020 | Kikuhara | |
| 2020/0162618 | A1 | 5/2020 | Enteshari | |
| 2020/0228663 | A1 | 7/2020 | Wells-Rutherford | |
| 2020/0251119 | A1 | 8/2020 | Yang | |
| 2020/0275204 | A1 | 8/2020 | Labosco | |
| 2020/0278043 | A1 | 9/2020 | Cao | |
| 2020/0288237 | A1 | 9/2020 | Abraham | |
| 2021/0012789 | A1 | 1/2021 | Husain | |
| 2021/0021940 | A1 | 1/2021 | Petersen | |
| 2021/0044881 | A1 | 2/2021 | Lantz | |
| 2021/0051397 | A1 | 2/2021 | Veselinovic | |
| 2021/0098014 | A1 | 4/2021 | Tanaka | |
| 2021/0098015 | A1 | 4/2021 | Pandey | |
| 2021/0120335 | A1 | 4/2021 | Veselinovic | |
| 2021/0200504 | A1 | 7/2021 | Park | |
| 2021/0375298 | A1 | 12/2021 | Zhang | |

FOREIGN PATENT DOCUMENTS

| | | |
|---|---|---|
| CA | 2505496 | 10/2006 |
| CA | 2838856 | 12/2012 |
| CA | 2846323 | 9/2014 |
| CN | 1780495 | 5/2006 |
| CN | 101217830 | 7/2008 |
| CN | 101833954 | 9/2010 |
| CN | 101860776 | 10/2010 |
| CN | 101894558 | 11/2010 |
| CN | 102646418 | 8/2012 |
| CN | 102821336 | 12/2012 |
| CN | 102833664 | 12/2012 |
| CN | 102860039 | 1/2013 |
| CN | 104036784 | 9/2014 |
| CN | 104053088 | 9/2014 |
| CN | 104080289 | 10/2014 |
| CN | 104347076 | 2/2015 |
| CN | 104581463 | 4/2015 |
| CN | 105355210 | 2/2016 |
| CN | 105548998 | 5/2016 |
| CN | 106162427 | 11/2016 |
| CN | 106251857 | 12/2016 |
| CN | 106851036 | 6/2017 |
| CN | 107221336 | 9/2017 |
| CN | 107534725 | 1/2018 |
| CN | 108172235 | 6/2018 |
| CN | 109087664 | 12/2018 |
| CN | 208190895 | 12/2018 |
| CN | 109727604 | 5/2019 |
| CN | 110010147 | 7/2019 |
| CN | 306391029 | 3/2021 |
| DE | 2941485 | 4/1981 |
| EM | 0077546430001 | 3/2020 |
| EP | 0381498 | 8/1990 |
| EP | 0594098 | 4/1994 |
| EP | 0869697 | 10/1998 |
| EP | 1180914 | 2/2002 |
| EP | 1184676 | 3/2002 |
| EP | 0944228 | 6/2003 |
| EP | 1439526 | 7/2004 |
| EP | 1651001 | 4/2006 |
| EP | 1727344 | 11/2006 |
| EP | 1906707 | 4/2008 |
| EP | 1952393 | 8/2008 |
| EP | 1962547 | 8/2008 |
| EP | 2133867 | 12/2009 |
| EP | 2159789 | 3/2010 |
| EP | 2197219 | 6/2010 |
| EP | 2360940 | 8/2011 |
| EP | 2710788 | 3/2014 |
| EP | 2721837 | 4/2014 |
| EP | 2772910 | 9/2014 |
| EP | 2778310 | 9/2014 |
| EP | 2942975 | 11/2015 |
| EP | 2988527 | 2/2016 |
| EP | 3035556 | 6/2016 |
| EP | 3131311 | 2/2017 |
| GB | 2393601 | 3/2004 |
| GB | 2446620 | 8/2008 |
| JP | S63144699 | 6/1988 |
| JP | H01260967 | 10/1989 |
| JP | H0241099 | 2/1990 |
| JP | H05260589 | 10/1993 |
| JP | H07336790 | 12/1995 |
| JP | 3175622 | 6/2001 |
| JP | 2003060530 | 2/2003 |
| JP | 2003087890 | 3/2003 |
| JP | 2004349806 | 12/2004 |
| JP | 2004537232 | 12/2004 |
| JP | 2005323084 | 11/2005 |
| JP | 2006094389 | 4/2006 |
| JP | 2006101499 | 4/2006 |
| JP | 4120646 | 8/2006 |
| JP | 4258472 | 8/2006 |
| JP | 4196956 | 9/2006 |
| JP | 2006340151 | 12/2006 |
| JP | 4760160 | 1/2007 |
| JP | 4752403 | 3/2007 |
| JP | 2007089058 | 4/2007 |
| JP | 4867579 | 6/2007 |
| JP | 2007208503 | 8/2007 |
| JP | 2007228069 | 9/2007 |
| JP | 2007228070 | 9/2007 |
| JP | 2007274131 | 10/2007 |
| JP | 2007274463 | 10/2007 |
| JP | 2007288679 | 11/2007 |
| JP | 2008005347 | 1/2008 |
| JP | 2008042754 | 2/2008 |
| JP | 2008154056 | 7/2008 |
| JP | 2008259022 | 10/2008 |
| JP | 2008263336 | 10/2008 |
| JP | 2008312002 | 12/2008 |
| JP | 2009206671 | 9/2009 |
| JP | 2010028653 | 2/2010 |
| JP | 2010114554 | 5/2010 |
| JP | 2010268129 | 11/2010 |
| JP | 2011015018 | 1/2011 |
| JP | 4779748 | 9/2011 |
| JP | 2012165189 | 8/2012 |
| JP | 5028944 | 9/2012 |

(56) References Cited

FOREIGN PATENT DOCUMENTS

| | | |
|---|---|---|
| JP | 5139111 | 2/2013 |
| JP | 5306565 | 10/2013 |
| JP | 5685173 | 3/2015 |
| JP | 2016051038 | 4/2016 |
| KR | 100298300 | 5/2001 |
| KR | 100901464 | 6/2009 |
| KR | 100960781 | 6/2010 |
| KR | 1020130033723 | 4/2013 |
| KR | 300856915 | 5/2016 |
| TW | 201331932 | 8/2013 |
| TW | I484478 | 5/2015 |
| WO | 1997008896 | 3/1997 |
| WO | 1998047291 | 10/1998 |
| WO | 2000030402 | 5/2000 |
| WO | 2003073786 | 9/2003 |
| WO | 2003088429 | 10/2003 |
| WO | 2004027754 | 4/2004 |
| WO | 2004090865 | 10/2004 |
| WO | 2006049260 | 5/2006 |
| WO | 2006071119 | 7/2006 |
| WO | 2006114015 | 11/2006 |
| WO | 2006121896 | 11/2006 |
| WO | 2007045971 | 4/2007 |
| WO | 2008074249 | 6/2008 |
| WO | 2008125523 | 10/2008 |
| WO | 2009039783 | 4/2009 |
| WO | 2009109069 | 9/2009 |
| WO | 2010001508 | 1/2010 |
| WO | 2010091999 | 8/2010 |
| WO | 2010140084 | 12/2010 |
| WO | 2010144148 | 12/2010 |
| WO | 2011104501 | 9/2011 |
| WO | 2012122132 | 9/2012 |
| WO | 2012140435 | 10/2012 |
| WO | 2012160459 | 11/2012 |
| WO | 2012174159 | 12/2012 |
| WO | 2013016986 | 2/2013 |
| WO | 2013182118 | 12/2013 |
| WO | 2014156292 | 10/2014 |
| WO | 2016176429 | 11/2016 |
| WO | 2016179211 | 11/2016 |
| WO | 2017208022 | 12/2017 |
| WO | 2018140444 | 8/2018 |
| WO | 2018140618 | 8/2018 |
| WO | 2018211806 | 11/2018 |
| WO | 2019231630 | 12/2019 |
| WO | 2020168873 | 8/2020 |
| WO | 2020191354 | 9/2020 |
| WO | 211843001 | 11/2020 |

OTHER PUBLICATIONS

"Philips Hue Bulbs and Wireless Connected Lighting System," Web page https://www.philips-hue.com/en-in, 8 pp, Sep. 23, 2020, retrieved from Internet Archive Wayback Machine, <https://web.archive.org/web/20200923171037/https://www.philips-hue.com/en-in> on Sep. 27, 2021.

"Vsa 2050 II Digitally steerable Column Speaker," Web page https://www.rcf.it/en_US/products/product-detail/vsa-2050-ii/972389, 15 pages, Dec. 24, 2018.

Advanced Network Devices, IPSCM Ceiling Tile IP Speaker, Feb. 2011, 2 pgs.

Advanced Network Devices, IPSCM Standard 2' by 2' Ceiling Tile Speaker, 2 pgs.

Affes, et al., "A Signal Subspace Tracking Algorithm for Microphone Array Processing of Speech," IEEE Trans. on Speech and Audio Processing, vol. 5, No. 5, Sep. 1997, pp. 425-437.

Affes, et al., "A Source Subspace Tracking Array of Microphones for Double Talk Situations," 1996 IEEE International Conference on Acoustics, Speech, and Signal Processing Conference Proceedings, May 1996, pp. 909-912.

Affes, et al., "An Algorithm for Multisource Beamforming and Multitarget Tracking," IEEE Trans. on Signal Processing, vol. 44, No. 6, Jun. 1996, pp. 1512-1522.

Affes, et al., "Robust Adaptive Beamforming via LMS-Like Target Tracking," Proceedings of IEEE International Conference on Acoustics, Speech and Signal Processing, Apr. 1994, pp. IV-269-IV-272.

Ahonen, et al, "Directional Analysis of Sound Field with Linear Microphone Array and Applications in Sound Reproduction," Audio Engineering Sooity, Convention Paper 7329, May 2008, 11 pp.

Alarifi, et al., "Ultra Wideband Indoor Positioning Technologies: Analysis and Recent Advances," Sensors 2016, vol. 16, No. 707, 36 pp.

Amazon webpage for Metalfab MFLCRFG (last visited Apr. 22, 2020) available at <https://www.amazon.com/RETURN-FILTERGRILLE-Drop-Ceiling/dp/B0064Q9A7I/ref=sr 12?dchild=1&keywords=drop+ceiling+return+air+grille&qid=1585862723&s=hi&sr=1-2>, 11 pp.

Armstrong "Walls" Catalog available at <https://www.armstrongceilings.com/content/dam/armstrongceilings/commercial/north-america/catalogs/armstrong-ceilings-wallsspecifiers-reference.pdf>, 2019, 30 pp.

Armstrong Tectum Ceiling & Wall Panels Catalog available at <https://www.armstrongceilings.com/content/dam/armstrongceilings/commercial/north-america/brochures/tectum-brochure.pdf>, 2019, 16 pp.

Armstrong Woodworks Concealed Catalog available at <https://sweets.construction.com/swts_content_files/3824/442581.pdf>, 2014, 6 pp.

Armstrong Woodworks Walls Catalog available at <https://www.armstrongceilings.com/pdbupimagesclg/220600.pdf/download/data-sheet-woodworks-walls.pdf>, 2019, 2 pp.

Armstrong World Industries, Inc., I-Ceilings Sound Systems Speaker Panels, 2002, 4 pgs.

Armstrong, Acoustical Design: Exposed Structure, available at <https://www.armstrongceilings.com/pdbupimagesclg/217142.pdf/download/acoustical-design-exposed-structurespaces-brochure.pdf>, 2018, 19 pp.

Armstrong, Ceiling Systems, Brochure page for Armstrong Softlook, 1995, 2 pp.

Armstrong, Excerpts from Armstrong 2011-2012 Ceiling Wall Systems Catalog, available at <https://web.archive.org/web/20121116034120/http://www.armstrong.com/commceilingsna/en_us/pdf/ceilings_catalog_screen-2011.pdf>, as early as 2012, 162 pp.

Armstrong, i-Ceilings, Brochure, 2009, 12 pp.

Arnold, et al., "A Directional Acoustic Array Using Silicon Micromachined Piezoresistive Microphones," Journal of the Acoustical Society of America, 113(1), Jan. 2003, 10 pp.

Atlas Sound, I128SYSM IP Compliant Loudspeaker System with Microphone Data Sheet, 2009, 2 pgs.

Atlas Sound,1'X2' IP Speaker with Micophone for Suspended Ceiling Systems, https://www.atlasied.com/i128sysm, retrieved Oct. 25, 2017, 5 pgs.

Audio Technica, ES945 Omnidirectional Condenser Boundary Microphones, https://eu.audio-technica.com/resouroes/ES945%20Specifications.pdf, 2007, 1 pg.

Audix Microphones, Audix Introduces Innovative Ceiling Mics, http://audixusa.com/docs_12/latest_news/EFplFkAAklOtSdolke.shtml, Jun. 2011, 6 pgs.

Audix Microphones, M70 Flush Mount Ceiling Mic, May 2016, 2 pgs.

Automixer Gated, Information Sheet, MIT, Nov. 2019, 9 pp.

AVNetwork, "Top Five Conference Room Mic Myths," Feb. 25, 2015, 14 pp.

Beh, et al., "Combining Acoustic Echo Cancellation and Adaptive Beamforming for Achieving Robust Speech Interface in Mobile Robot," 2008 IEEE/RSJ International Conference on Intelligent Robots and Systems, Sep. 2008, pp. 1693-1698.

Benesty, et al., "A New Class of Doubletalk Detectors Based on Cross-Correlation," IEEE Transactions on Speech and Audio Processing, vol. 8, No. 2, Mar. 2000, pp. 168-172.

Benesty, et al., "Adaptive Algorithms for Mimo Acoustic Echo Cancellation," AI2 Allen Institute for Artifical Intelligence, 2003.

(56) References Cited

OTHER PUBLICATIONS

Benesty, et al., "Differential Beamforming," Fundamentals of Signal Enhancement and Array Signal Processing, First Edition, 2017, 39 pp.
Benesty, et al., "Frequency-Domain Adaptive Filtering Revisited, Generalization to the Multi-Channel Case, and Application to Acoustic Echo Cancellation," 2000 IEEE International Conference on Acoustics, Speech, and Signal Processing Proceedings, Jun. 2000, pp. 789-792.
Benesty, et. Al., "Microphone Array Signal Processing," Springer, 2010, 20 pp.
Berkun, et al., "Combined Beamformers for Robust Broadband Regularized Superdirective Beamforming," IEEE/ACM Transactions on Audio, Speech, and Language Processing, vol. 23, No. 5, May 2015, 10 pp.
Beyer Dynamic, Classis BM 32-33-34 DE-EN-FR 2016, 1 pg.
Beyer Dynamic, Classis-BM-33-PZ A1, 2013, 1 pg.
BNO055, Intelligent 9-axis absolute orientation sensor, Data sheet, Bosch, Nov. 2020, 118 pp.
Boyd, et al., Convex Optimization, Mar. 15, 1999, 216 pgs.
Brandstein, el al., "Microphone Arrays: Signal Processing Techniques and Applications," Digital Signal Processing, Springer-Verlag Berlin Heidelberg, 2001, 401 pgs.
Brooks, et al., "A Quantitative Assessment of Group Delay Methods for Identifying Glottal Closures in Voiced Speech," IEEE Transaction on Audio, Speech, and Language Processing, vol. 14, No. 2, Mar. 2006, 11 pp.
Bruel & Kjaer, by J.J. Christensen and J. Hald, Technical Review: Beamforming, No. 1, 2004, 54 pgs.
BSS Audio, Soundweb London Application Guides, 2010, 120 pgs.
Buchner, et al., "An Acoustic Human-Machine Interface with Multi-Channel Sound Reproduction," IEEE Fourth Workshop on Multimedia Signal Processing, Oct. 2001, pp. 359-364.
Buchner, et al., "An Efficient Combination of Multi-Channel Acoustic Echo Cancellation with a Beamforming Microphone Array," International Workshop on Hands-Free Speech Communication (HSC2001), Apr. 2001, pp. 55-58.
Buchner, et al., "Full-Duplex Communication Systems Using Loudspeaker Arrays and Microphone Arrays," IEEE International Conference on Multimedia and Expo, Aug. 2002, pp. 509-512.
Buchner, et al., "Generalized Multichannel Frequency-Domain Adaptive Filtering: Efficient Realization and Application to Hands-Free Speech Communication," Signal Processing 85, 2005, pp. 549-570.
Buchner, et al., "Multichannel Frequency-Domain Adaptive Filtering with Application to Multichannel Acoustic Echo Cancellation," Adaptive Signal Processing, 2003, pp. 95-128.
Buck, "Aspects of First-Order Differential Microphone Arrays in the Presence of Sensor Imperfections," Transactions on Emerging Telecommunications Technologies, 13.2, 2002, 8 pp.
Buck, et al., "First Order Differential Microphone Arrays for Automotive Applications," 7th International Workshop on Acoustic Echo and Noise Control, Darmstadt University of Technology, Sep. 10-13, 2001, 4 pp.
Buck, et al., "Self-Calibrating Microphone Arrays for Speech Signal Acquisition: A Systematic Approach," Signal Processing, vol. 86, 2006, pp. 1230-1238.
Burton, et al., "A New Structure for Combining Echo Cancellation and Beamforming in Changing Acoustical Environments," IEEE International Conference on Acoustics, Speech and Signal Processing, 2007, pp. 1-77-1-80.
BZ-3a Installation Instructions, XEDIT Corporation, Available at <chrome-extension://efaidnbmnnnibpcajpcglclefindmkaj/viewer.html?pdfurl=https%3A%2F%2Fwww.servoreelers.com%2Fmt-content%2Fuploads%2F2017%2F05%2bz-a-3universal-2017c.pdf&clen=189067&chunk=true>, 1 p.
Cabral, et al., Glottal Spectral Separation for Speech Synthesis, IEEE Journal of Selected Topics in Signal Processing, 2013, 15 pp.
Campbell, "Adaptive Beamforming Using a Microphone Array for Hands-Free Telephony," Virginia Polytechnic Institute and State University, Feb. 1999, 154 pgs.
Canetto, et al., "Speech Enhancement Systems Based on Microphone Arrays," VI Conference of the Italian Society for Applied and Industrial Mathematics, May 27, 2002, 9 pp.
Cao, "Survey on Acoustic Vector Sensor and its Applications in Signal Processing" Proceedings of the 33rd Chinese Control Conference, Jul. 2014, 17 pp.
Cech, et al., "Active-Speaker Detection and Localization with Microphones and Cameras Embedded into a Robotic Head," IEEE-RAS International Conference on Humanoid Robots, Oct. 2013, pp. 203-210.
Chan, et al., "Uniform Concentric Circular Arrays with Frequency-Invariant Characteristics—Theory, Design, Adaptive Beamforming and DOA Estimation," IEEE Transactions on Signal Processing, vol. 55, No. 1, Jan. 2007, pp. 165-177.
Chau, et al., "A Subband Beamformer on an Ultra Low-Power Miniature DSP Platform," 2002 IEEE International Conference on Acoustics, Speech, and Signal Processing, 4 pp.
Chen, et al., "A General Approach to the Design and Implementation of Linear Differential Microphone Arrays," Signal and Information Processing Association Annual Summit and Conference, 2013 Asia-Pacific, IEEE, 7 pp.
Chen, et al., "Design and Implementation of Small Microphone Arrays," PowerPoint Presentation, Northwestern Polytechnical University and Institut national de la recherche scientifique, Jan. 1, 2014, 56 pp.
Chen, et al., "Design of Robust Broadband Beamformers with Passband Shaping Characteristics using Tikhonov Regularization," IEEE Transactions on Audio, Speech, and Language Processing, vol. 17, No.4, May 2009, pp. 565-681.
Chou, "Frequency-Independent Beamformer with Low Response Error," 1995 International Conference on Acoustics, Speech, and Signal Processing, pp. 2995-2998, May 9, 1995, 4 pp.
Chu, "Desktop Mic Array for Teleconferencing," 1995 International Conference on Acoustics, Speech, and Signal Processing, May 1995, pp. 2999-3002.
Circuit Specialists webpage for an aluminum enclosure, available at <https://www.circuitspecialists.com/metal-instrument-enclosure-la7.html?otaid=gpl&gclid=EAIaIQobChMI2JTw-Ynm6AIVgbblCh3F4QKuEAkYBiABEgJZMPD_BwE>, 3 pp.
ClearOne Introduces Ceiling Microphone Array With Built-In Danie Interface, Press Release; GlobeNewswire, Jan. 8, 2019, 2 pp.
ClearOne Launches Second Generation of its Groundbreaking Beamforming Microphone Array, Press Release, Acquire Media, Jun. 1, 2016, 2 pp.
ClearOne to Unveil Beamforming Microphone Array with Adaptive Steering and Next Generation Acoustic Echo Cancellation Technology, Press Release, InfoComm, Jun. 4, 2012, 1 p.
ClearOne, Clearly Speaking Blog, "Advanced Beamforming Microphone Array Technology for Corporate Conferencing Systems," Nov. 11, 2013, 5 pp., http://wwwclearone.com/blog/advanced-beamforming-microphone-array-technology-for-corporate-conferencing-systems/.
ClearOne, Beamforming Microphone Array, Mar. 2012, 6 pgs.
ClearOne, Ceiling Microphone Array Installation Manual, Jan. 9, 2012, 20 pgs.
ClearOne, Converge/Converge Pro, Manual, 2008, 51 pp.
ClearOne, Professional Conferencing Microphones, Brochure, Mar. 2015, 3 pp.
Coleman, "Loudspeaker Array Processing for Personal Sound Zone Reproduction," Centre for Vision, Speech and Signal Processing, 2014, 239 pp.
Cook, et al., An Alternative Approach to Interpolated Array Processing for Uniform Circular Arrays, Asia-Pacific Conference on Circuits and Systems, 2002, pp. 411-414.
Cox, et al., "Robust Adaptive Beamforming," IEEE Trans. Acoust., Speech, and Signal Processing, vol. ASSP-35, No. 10, Oct. 1987, pp. 1365-1376.
CTG Audio, Ceiling Microphone CTG CM-01, Jun. 5, 2008, 2 pgs.
CTG Audio, CM-01 & CM-02 Ceiling Microphones Specifications, 2 pgs.
CTG Audio, CM-01 & CM-02 Ceiling Microphones, 2017, 4 pgs.
CTG Audio, CTG FS-400 and RS-800 with "Beamforming" Technology, Datasheet, As early as 2009, 2 pp.

(56) References Cited

OTHER PUBLICATIONS

CTG Audio, CTG User Manual forihe FS-400/800 Beamforming Mixers, Nov. 2008, 26 pp.
CTG Audio, Expand Your IP Teleconferencing to Full Room Audio, Obtained from website htt. )://www ct audio com/ex and-, our-i-teleconforencino-to-ful-room-audio-whiIe-conquennc.1-echo-cancelation-issues Mull, 2014.
CTG Audio, Frequently Asked Questions, As early as 2009, 2 pp.
CTG Audio, Installation Manual and User Guidelines forthe Soundman SM 02 System, May 2001, 29 pp.
CTG Audio, Installation Manual, Nov. 21, 2008, 25 pgs.
CTG Audio, Introducing the CTG FS-400 and FS-800 with Beamforming Technology, As early as 2008, 2 pp.
CTG Audio, Meeting the Demand for Ceiling Mics in the Enterprise 5 Best Practices, Brochure, 2012, 9 pp.
CTG Audio, White on White—Introducing the CM-02 Ceiling Microphone, https://ctgaudio.com/white-on-white-introducing-the-cm-02-ceiling-microphone/, Feb. 20, 2014, 3 pgs.
Dahl et al., Acoustic Echo Cancelling with Microphone Arrays, Research Report Mar. 1995, Univ. of Karlskrona/Ronneby, Apr. 1995, 64 pgs.
Decawave, Application Note: APR001, UWB Regulations, A Summary of Worldwide Telecommunications Regulations governing the use of Ultra-Wideband radio, Version 1.2, 2015, 63 pp.
Desiraju, et al., "Efficient Multi-Channel Acoustic Echo Cancellation Using Constrained Sparse Filter Updates in the Subband Domain," Acoustic Speech Enhancement Research, Sep. 2014, 4 pp.
DiBiase. et al., Robust Localization in Reverberent Rooms, in Brandstein, ed., Microphone Arrays: Techniques and Applications, 2001, Springer-Verlag Berlin Heidelberg, pp. 157-180.
Diethorn, "Audio Signal Processing for Next-Generation Multimedia Communication Systems," Chapter 4, 2004, 9 pp.
Digikey webpage for Converta box (last visited Apr. 22, 2020) <https://www.digikey.com/product-detail/en/bud-industries/CU-452-A/377-1969-ND/439257?utm_adgroup=Boxes&utm_source=google&utm_medium=cpc&utm_campaign=Shopping_Boxes%2C%20Enclosures%2C%20Racks_NEW&utm_term=&utm_content=Boxes&gclid=EAIaIQobChMI2JTw-Ynm6AIVgbblCh3F4QKuEAkYCSABEgKybPD_BwE>, 3 pp.
Digikey webpage for Pomona Box (last visited Apr. 22, 2020) available at <https://www.digikey.com/product-detail/en/pomonaelectronics/3306/501-2054-ND/736489>, 2 pp.
Digital Wireless Conference System, MCW-D 50, Beyerdynamic Inc., 2009, 18 pp.
Do et al., A Real-Time SRP-PHAT Source Location Implementation using Stochastic Region Contraction (SRC) on a Large-Aperture Microphone Array, 2007 IEEE International Conference on Acoustics, Speech and Signal Processing—ICASSP '07, , Apr. 2007, pp. I-121-I-124.
Dominguez, et al., "Towards an Environmental Measurement Cloud: Delivering Pollution Awareness to the Public," International Journal of Distributed Sensor Networks, vol. 10, Issue 3, Mar. 31, 2014, 17 pp.
Dormehl, "HoloLens concept lets you control your smart home via augmented reality," digitaltrends, Jul. 26, 2016, 12 pp.
Double Condenser Microphone SM 69, Datasheet, Georg Neumann GmbH, available at <https://ende.neumann.com/product_files/7453/download>, 8 pp.
Eargle, "The Microphone Handbook,"Elar Publ. Co., 1st ed., 1981, 4 pp.
Enright, Notes From Logan, June edition of Scanlines, Jun. 2009, 9 pp.
Fan, et al., "Localization Estimation of Sound Source by Microphones Array," Procedia Engineering 7, 2010, pp. 312-317.
Firoozabadi, et al., "Combination of Nested Microphone Array and Subband Processing for Multiple Simultaneous Speaker Localization," 6th International Symposium on Telecommunications, Nov. 2012, pp. 907-912.
Flanagan et al., Autodirective Microphone Systems, Acustica, vol. 73, 1991, pp. 58-71.
Flanagan, et al., "Computer-Steered Microphone Arrays for Sound Transduction in Large Rooms," J. Acoust. Soc. Am. 78 (5), Nov. 1985, pp. 1508-1518.
Fohhn Audio New Generation of Beam Steering Systems Available Now, audioXpress Staff, May 10, 2017, 8 pp.
Fox, et al., "A Subband Hybrid Beamforming for In-Car Speech Enhancement," 20th European Signal rocessing Conference, Aug. 2012, 5 pp.
Frost, III, An Algorithm for Linearly Constrained Adaptive Array Processing, Proc. IEEE, vol. 60, No. 8, Aug. 1972, pp. 926-935.
Gannot et al., Signal Enhancement using Beamforming and Nonstalionarity with Applications to Speech, IEEE Trans. on Signal Processing, vol. 49, No. 8, Aug. 2001, pp. 1614-1626.
Gansler et al., A Double-Talk Detector Based on Coherence, IEEE Transactions on Communications, vol. 44, No. 11, Nov. 1996, pp. 1421-1427.
Gazor et al., Robust Adaptive Beamforming via Target Tracking, IEEE Transactions on Signal Processing, vol. 44, No. 6, Jun. 1996, pp. 1589-1593.
Gazor et al., Wideband Multi-Source Beamforming with Adaptive Array Location Calibration and Direction Finding, 1995 International Conference on Acoustics, Speech, and Signal Processing, May 1995, pp. 1904-1907.
Gentner Communications Corp., AP400 Audio Perfect 400 Audioconferencing System Installation & Operation Manual, Nov. 1998, 80 pgs.
Gentner Communications Corp., XAP 800 Audio Conferencing System Installation & Operation Manual, Oct. 2001, 152 pgs.
Gil-Cacho et al., Multi-Microphone Acoustic Echo Cancellation Using Multi-Channel Warped Linear Prediction of Common Acoustical Poles, 18th European Signal Processing Conference, Aug. 2010, pp. 2121-2125.
Giuliani, et al., "Use of Different Microphone Array Configurations for Hands-Free Speech Recognition in Noisy and Reverberant Environment," IRST—Istituto per la Ricerca Scientifica e Tecnologica, Sep. 22, 1997, 4 pp.
Gritton et al., Echo Cancellation Algorithms, IEEE ASSP Magazine, vol. 1, issue 2, Apr. 1984, pp. 30-38.
Hald, et al., "A class of optimal broadband phased array geometries designed for easy construction," 2002 Int'l Congress & Expo. on Noise Control Engineering, Aug. 2002, 6 pp.
Hamalainen, et al., "Acoustic Echo Cancellation for Dynamically Steered Microphone Array Systems," 2007 IEEE Workshop on Applications of Signal Processing to Audio and Acoustics, Oct. 2007, pp. 58-61.
Hayo, Virtual Controls for Real Life, Web page downloaded from https://hayo.io/ on Sep. 18, 2019, 19 pp.
Herbordt et al., A Real-time Acoustic Human-Machine Front-End for Multimedia Applications Integrating Robust Adaptive Beamforrning and Stereophonic Acoustic Echo Cancellation, 7th International Conference on Spoken Language Processing, Sep. 2002, 4 pgs.
Herbordt et al., GSAEC—Acoustic Echo Cancellation embedded into the Generalized Sidelobe Canceller, 10th European Signal Processing Conference, Sep. 2000, 5 pgs.
Herbordt et al., Multichannel Bin-Wise Robust Frequency-Domain Adaptive Filtering and Its Application to Adaptive Beamforming, IEEE Transactions on Audio, Speech, and Language Processing, vol. 15, No. 4, May 2007, pp. 1340-1351.
Herbordt, "Combination of Robust Adaptive Beamforming with Acoustic Echo Cancellation for Acoustic Human/Machine Interfaces," Friedrich-Alexander University, 2003, 293 pgs.
Herbordt, et al., Joint Optimization of LCMV Beamforming and Acoustic Echo Cancellation for Automatic Speech Recognition, IEEE International Conference on Acoustics, Speech, and Signal Processing, Mar. 2005, pp. III-77-III-80.
Holm, "Optimizing Microphone Arrays for use in Conference Halls," Norwegian University of Science and Technology, Jun. 2009, 101 pp.
Huang el al., Immersive Audio Schemes: The Evolution of Multipany Teleconferencing, IEEE Signal Processing Magazine, Jan. 2011, pp. 20-32.

(56) References Cited

OTHER PUBLICATIONS

ICONYX Gen5, Product Overview; Renkus-Heinz, Dec. 24, 2018, 2 pp.
International Search Report and Written Opinion for PCT/US2016/022773 dated Jun. 10, 2016.
International Search Repon and Written Opinion for PCT/US2016/029751 dated Nov. 28, 2016, 21 pp.
International Search Report and Written Opinion for PCT/US2018/013155 dated Jun. 8, 2018.
International Search Repon and Written Opinion for PCT/US2019/031833 dated Jul. 24, 2019, 16 pp.
International Search Report and Written Opinion for PCT/US2019/033470 dated Jul. 31, 2019, 12 pp.
International Search Report and Written Opinion for PCT/US2019/051989 dated Jan. 10, 2020, 15 pp.
International Search Report and Written Opinion for PCT/US2020/024063 dated Aug. 31, 2020, 18 pp.
International Search Report and Written Opinion for PCT/US2020/035185 dated Sep. 15, 2020, 11 pp.
International Search Report and Written Opinion for PCT/US2020/058385 dated Mar. 31, 2021 , 20 pp.
International Search Report and Written Opinion for PCT/US2021/070625 dated Sep. 17, 2021, 17 pp.
International Search Repon for PCT/US2020/024005 dated Jun. 12, 2020, 12 pp.
InvenSense, "Microphone Array Beamforming," Application Note AN-1140, Dec. 31, 2013, 12 pp.
Invensense, Recommendations for Mounting and Connecting InvenSense MEMS Microphones, Application Note AN-1003, 2013, 11 pp.
Ishii et al., Investigation on Sound Localization using Multiple Microphone Arrays, Reflection and Spatial Information, Japanese Society for Artificial Intelligence, JSAI Technical Report, SIG-Challenge—B202-11, 2012, pp. 64-69.
Ito et al., Aerodynamic/Aeroacoustio Testing in Anechoic Closed Test Sections of Low-speed Wind Tunnels, 16th AIAA/CEAS Aeroacoustics Conference, 2010, 11 pgs.
Johansson et al., Robust Acoustic Direction of Arrival Estimation using Root-SRP-PHAT, a Realtime Implementation, IEEE International Conference on Acoustics, Speech, and Signal Processing, Mar. 2005, 4 pgs.
Johansson, et al., Speaker Localisation using the Far-Field SRP-PHAT in Conference Telephony, 2002 International Symposium on Intelligent Signal Processing and Communication Systems, 5 pgs.
Johnson, et al., "Array Signal Processing: Concepts and Techniques," p. 59, Prentice Hall, 1993, 3 pp.
Julstrom et al., Direction-Sensitive Gating: A New Approach to Automatic Mixing, J. Audio Eng. Soc., vol. 32, No. 7/8, Jul./Aug. 1984, pp. 490-506.
Kahrs, Ed., The Past, Present, and Future of Audio Signal Processing, IEEE Signal Processing Magazine, Sep. 1997, pp. 30-57.
Kallinger et al., Multi-Microphone Residual Echo Estimation, 2003 IEEE International Conference on Acoustics, Speech, and Signal Processing, Apr. 2003, 4 pgs.
Kammeyer, et al., New Aspects of Combining Echo Cancellers with Beamformers, IEEE International Conference on Acoustics, Speech, and Signal Processing, Mar. 2005, pp. III-137-III-140.
Kellermann, A Self-Steering Digital Microphone Array, 1991 International Conference on Acoustics, Speech, and Signal Processing, Apr. 1991, pp. 3581-3584.
Kellermann, Acoustic Echo Cancellation for Beamforming Microphone Arrays, in Brandstein, ed., Microphone Arrays: Techniques and Applications, 2001, Springer-Verlag Berlin Heidelberg, pp. 281-306.
Kellermann, Integrating Acoustic Echo Cancellation with Adaptive Beamforming Microphone Arrays, Forum Acusticum, Berlin, Mar. 1999, pp. 1-4.
Kellermann, Strategies for Combining Acoustic Echo Cancellation and Adaptive Beamforming Microphone Arrays, 1997 IEEE International Conference on Acoustics, Speech, and Signal Processing, Apr. 1997, 4 pgs.
Klegon, "Achieve Invisible Audio with the MXA910 Ceiling Array Microphone," Jun. 27, 2016, 10 pp.
Knapp, et al., The Generalized Correlation Method for Estimation of Time Delay, IEEE Transactions on Acoustics, Speech, and Signal Processing, vol. ASSP-24, No. 4, Aug. 1976, pp. 320-327.
Kobayashi et al., A Hands-Free Unit with Noise Reduction by Using Adaptive Beamformer, IEEE Transactions on Consumer Electronics, vol. 54, No. 1, Feb. 2008, pp. 116-122.
Kobayashi et al., A Microphone Array System with Echo Canceller, Electronics and Communications in Japan, Part 3, vol. 89, No. 10, Feb. 2, 2006, pp. 23-32.
Kolundžija, et al., "Baffled circular loudspeaker array with broadband high directivity," 2010 IEEE International Conference on Acoustics, Speech and Signal Processing, Dallas, TX, 2010, pp. 73-76.
Lai, et al., "Design of Robust steerable Broadband Beamformers with Spiral Arrays and the Farrow Filter Structure," Proc. Intl. Workshop Acoustic Echo Noise Control, 2010, 4 pp.
Lebret, et al., Antenna Array Pattern Synthesis via Convex Optimization, IEEE Trans. on Signal Processing, vol. 45, No. 3, Mar. 1997, pp. 526-532.
LecNet2 Sound System Design Guide, Lectrosonics, Jun. 2, 2006.
Lectrosonics, LecNet2 Sound System Design Guide, June 2006, 28 pgs.
Lee et al., Multichannel Teleconferencing System with Multispatial Region Acoustic Echo Cancellation, International Workshop on Acoustic Echo and Noise Control (IWAENC2003), Sep. 2003, pp. 51-54.
Li, "Broadband Beamforming and Direction Finding Using Concentric Ring Array," Ph.D. Dissertation, University of Missouri-Columbia, Jul. 2005, 163 pp.
Lindstrom et al., An Improvement of the Two-Path Algorithm Transfer Logic for Acoustic Echo Cancellation, IEEE Transactions on Audio, Speech, and Language Processing, vol. 15, No. 4, May 2007, pp. 1320-1326.
Liu et al., Adaptive Beamforming with Sidelobe Control: A Second-Order Cone Programming Approach, IEEE Signal Proc. Letters, vol. 10, No. 11, Nov. 2003, pp. 331-334.
Liu, et al., "Frequency Invariant Beamforming in Subbands," IEEE Conference on Signals, Systems and Computers, 2004, 5 pp.
Liu, et al., "Wideband Beamforming," Wiley Series on Wireless Communications and Mobile Computing, pp. 143-198, 2010, 297 pp.
Lobo, et al., Applications of Second-Order Cone Programming, Linear Algebra and its Applications 284, 1998, pp. 193-228.
Luo et al., Wideband Beamforming with Broad Nulls of Nested Array, Third Int'l Conf. on Info. Science and Tech., Mar. 23-25, 2013, pp. 1645-1648.
Marquardt et al., A Natural Acoustic Front-End for Interactive TV in the EU-Project DICIT, IEEE Pacific Rim Conference on Communications, Computers and Signal Processing, Aug. 2009, pp. 894-899.
Marlin, Small Microphone Arrays with Postfilters for Noise and Acoustic Echo Reduction, in Brandstein, ed., Microphone Arrays: Techniques and Applications, 2001, Springer-Verlag Berlin Heidelberg, pp. 255-279.
Maruo et al., On the Optimal Solutions of Beamformer Assisted Acoustic Echo Cancellers, IEEE Statistical Signal Processing Workshop, 2011, pp. 641-644.
McGowan, Microphone Arrays: A Tutorial, Apr. 2001, 36 pgs.
MFLCRFG Datasheet, Metal_Fab Inc., Sep. 7, 2007, 1 p.
Microphone Array Primer, Shure Question and Answer Page, <https://service.shure.com/s/article/microphone-array-primer?language=en_US>, Jan. 2019, 5 pp.
Milanovic, et al., "Design and Realization of FPGA Platform for Real Time Acoustic Signal Acquisition and Data Processing" 22nd Telecommunications Forum TELFOR, 2014, 6 pp.

(56) References Cited

OTHER PUBLICATIONS

Mohammed, A New Adaptive Beamformer for Optimal Acoustic Echo and Noise Cancellation with Less Computational Load, Canadian Conference on Electrical and Computer Engineering, May 2008, pp. 000123-000128.
Mohammed, A New Robust Adaptive Beamformer for Enhancing Speech Corrupted with Colored Noise, AICCSA, Apr. 2008, pp. 508-515.
Mohammed, Real-time Implementation of an efficient RLS Algorithm based on IIR Filter for Acoustic Echo Cancellation, AICCSA, Apr. 2008, pp. 489-494.
Mohan, et al., "Localization of multiple acoustic sources with small arrays using a coherence test," Journal Acoustic Soc Am., 123(4), Apr. 2008, 12 pp.
Moulines, et al., "Pitch-Synchronous Waveform Processing Techniques for Text-to-Speech Synthesis Using Diphones," Speech Communication 9, 1990, 15 pp.
Multichannel Acoustic Echo Cancellation, Obtained from website http://www.buchner-net.com/mcaec.html, Jun. 2011.
Myllyla et al., Adaptive Beamforming Methods for Dynamically Steered Microphone Array Systems, 2008 IEEE International Conference on Acoustics, Speech and Signal Processing, Mar.-Apr. 2008, pp. 305-308.
New Shure Microflex Advance MXA910 Microphone With Intellimix Audio Processing Provides Greater Simplicity, Flexibility, Clarity, Press Release, Jun. 12, 2019, 4 pp.
Nguyen-Ky, et al., "An Improved Error Estimation Algorithm for Stereophonic Acoustic Echo Cancellation Systems," 1st International Conference on Signal Processing and Communication Systems, Dec. 17-19, 2007, 5 pp.
Office Action for Taiwan Patent Application No. 105109900 dated May 5, 2017.
Office Action issued for Japanese Patent Application No. 2015-023781 dated Jun. 20, 2016, 4 pp.
Oh, et al., "Hands-Free Voice Communication in an Automobile With a Microphone Array," 1992 IEEE International Conference on Acoustics, Speech, and Signal Processing, Mar. 1992, pp. I-281-I-284.
Olszewski, et al., "Steerable Highly Directional Audio Beam Loudspeaker," Interspeech 2005, 4 pp.
Omologo, Multi-Microphone Signal Processing for Distant-Speech Interaction, Human Activity and Vision Summer School (HAVSS), INRIA Sophia Antipolis, Oct. 3, 2012, 79 pgs.
Order, Conduct of the Proceeding, *Clearone, Inc.* v. *Shure Acquisition Holdings, Inc.*, Nov. 2, 2020, 10 pp.
Pados et al., An Iterative Algorithm for the Computation of the MVDR Filter, IEEE Trans. on Signal Processing, vol. 49, No. 2, Feb. 2001, pp. 290-300.
Palladino, "This App Lets You Control Your Smarthome Lights via Augmented Reality," Next Reality Mobile AR News, Jul. 2, 2018, 5 pp.
Parikh, et al., "Methods for Mitigating IP Network Packet Loss in Real Time Audio Streaming Applications," GatesAir, 2014, 6 pp.
Pasha, et al., "Clustered Multi-channel Dereverberation for Ad-hoc Microphone Arrays," Proceedings of APSIPA Annual Summit and Conference, Dec. 2015, pp. 274-278.
Petitioner's Motion for Sanctions, *Clearone, Inc.* v. *Shure Acquisition Holdings, Inc.*, Aug. 24, 2020, 20 pp.
Pettersen, "Broadcast Applications for Voice-Activated Microphones," db, Jul./Aug. 1985, 6 pgs.
Pfeifenberger, et al., "Nonlinear Residual Echo Suppression using a Recurrent Neural Network," Interspeech 2020, 5 pp.
Phoenix Audio Technologies, "Beamforming and Microphone Arrays—Common Myths", Apr. 2016, http://info.phnxaudio.com/blog/microphone-arrays-beamforming-myths-1, 19 pp.
Plascore, PCGA-XR1 3003 Aluminum Honeycomb Data Sheet, 2008, 2 pgs.
Polycom Inc., Vortex EF2211/EF2210 Reference Manual, 2003, 66 pgs.
Polycom, Inc., Polycom SoundStructure C16, C12, C8, and SR12 Design Guide, Nov. 2013, 743 pgs.
Polycom, Inc., Setting Up the Polycom HDX Ceiling Microphone Array Series, https://support.polycom.com/content/dam/polycom-support/products/Telepresence-and-Video/HDX%20Series/setup-maintenance/en/hdx_ceiling_microphone_array_setting_up.pdf, 2010, 16 pgs.
Polycom, Inc., Vortex EF2241 Reference Manual, 2002, 68 pgs.
Polycom, Inc., Vor1ex EF2280 Reference Manual, 2001, 60 pp.
Pomona, Model 3306, Datasheet, Jun. 9, 1999, 1 p.
Powers, et al., "Proving Adaptive Directional Technology Works: A Review of Studies," The Hearing Review, Apr. 6, 2004, 5 pp.
Prime, et al., "Beamforming Array Optimisation Averaged Sound Source Mapping on a Model Wind Turbine," ResearchGate, Nov. 2014, 10 pp.
Rabinkin et al., Estimation of Wavefront Arrival Delay Using the Cross-Power Spectrum Phase Technique, 132nd Meeting of the Acoustical Society of America, Dec. 1996, pp. 1-10.
Rane Corp., Halogen Acoustic Echo Cancellation Guide, AEC Guide Version 2, Nov. 2013, 16 pgs.
Rao, et al., "Fast LMS/Newton Algorithms for Stereophonic Acoustic Echo Cancelation," IEEE Transactions on Signal Processing, vol. 57, No. 8, Aug. 2009.
Reuven et al., Joint Acoustic Echo Cancellation and Transfer Function GSC in the Frequency Domain, 23rd IEEE Convention of Electrical and Electronics Engineers in Israel, Sep. 2004, pp. 412-415.
Reuven et al., Joint Noise Reduction and Acoustic Echo Cancellation Using the Transfer-Function Generalized Sidelobe Canceller, Speech Communication, vol. 49, 2007, pp. 623-635.
Reuven, et al., "Multichannel Acoustic Echo Cancellation and Noise Reduction in Reverberant Environments Using the Transfer-Function GSC," 2007 IEEE International Conference on Acoustics, Speech and Signal Processing, Apr. 2007, 4 pp.
Ristimaki, Distributed Microphone Array System for Two-Way Audio Communication, Helsinki Univ. of Technology, Master's Thesis, Jun. 15, 2009, 73 pgs.
Rombouts et al., An Integrated Approach to Acoustic Noise and Echo Cancellation, Signal Processing 85, 2005, pp. 849-871.
Sällberg, "Faster Subband Signal Processing," IEEE Signal Processing Magazine, vol. 30, No. 5, Sep. 2013, 6 pp.
Sasaki et al., A Predefined Command Recognition System Using a Ceiling Microphone Array in Noisy Housing Environments, 2008 lEEE/RSJ International Conference on Intelligent Robots and Systems, Sep. 2008, pp. 2178-2184.
Sennheiser, New microphone solutions for ceiling and desk installation, https://en-us.sennheiser.com/news-new-microphone-solutions-for-ceiling-and-desk-installation, Feb. 2011, 2 pgs.
Sennheiser, TeamConnect Ceiling, https://en-us.sennheiser.com/conference-meeting-rooms-teamconnect-ceiling, 2017, 7 pgs.
SerDes, Wikipedia article, last edited on Jun. 25, 2018; retrieved on Jun. 27, 2018, 3 pp., https://en.wikipedia.org/wiki/SerDes.
Sessler, et al., "Directional Transducers," IEEE Transactions on Audio and Electroacoustics, vol. AU-19, No. 1, Mar. 1971, pp. 19-23.
Sessler, et al., "Toroidal Microphones," Journal of Acoustical Society of America, vol. 46, No. 1, 1969, 10 pp.
Shure AMS Update, vol. 1, No. 1, 1983, 2 pgs.
Shure AMS Update, vol. 1, No. 2, 1983, 2 pgs.
Shure AMS Update, vol. 4, No. 4, 1997, 8 pgs.
Shure Debuts Microflex Advance Ceiling and Table Array Microphones, Press Release, Feb. 9, 2016, 4 pp.
Shure Inc., A910-HCM Hard Ceiling Mount, retrieved from website <http://www.shure.com/en-US/products/accessories/a910hcm> on Jan. 16, 2020, 3 pp.
Shure Inc., Microflex Advance, http://www.shure.com/americas/microflex-advance, 12 pgs.
Shure Inc., MX395 Low Profile Boundary Microphones, 2007, 2 pgs.
Shure Inc., MXA910 Ceiling Array Microphone, http://www.shure.com/americas/products/microphones/microflex-advance/mxa910-ceiling-array-microphone, 7 pgs.

(56) References Cited

OTHER PUBLICATIONS

Shure, MXA910 With IntelliMix, Ceiling Array Microphone, available at <https://www.shure.com/en-US/products/microphones/mxa910>, as early as 2020, 12 pp.
Shure, New MXA910 Variant Now Available, Press Release, Dec. 13, 2019, 5 pp.
Shure, Q&A in Response to Recent Us Court Ruling on Shure MXA910, Available at <https://www.shure.com/en-US/meta/legal/q-and-a-inresponse-to-recent-us-court-ruling-on-shure-mxa910-response>, As early as 2020, 5 pp.
Shure, RK244G Replacement Screen and Grille, Datasheet, 2013, 1 p.
Shure, The Microflex Advance MXA310 Table Array Microphone, Available at <https://www.shure.com/en-US/products/microphones/mxa310>, As early as 2020, 12 pp.
Signal Processor MRX7-D Product Specifications, Yamaha Corporation, 2016.
Silverman et al., Performance of Real-Time Source-Location Estimators for a Large-Aperture Microphone Array, IEEE Transactions on Speech and Audio Processing, vol. 13, No. 4, Jul. 2005, pp. 593-606.
Sinha, Ch. 9: Noise and Echo Cancellation, in Speech Processing in Embedded Systems, Springer, 2010, pp. 127-142.
SM 69 Stereo Microphone, Datasheet, Georg Neumann GmbH, Available at <https://ende.neumann.com/product_files/6552/download>, 1 p.
Soda et al., Introducing Multiple Microphone Arrays for Enhancing Smart Home Voice Control, The Institute of Electronics, Information and Communication Engineers, Technical Report of IEICE, Jan. 2013, 6 pgs.
Soundweb London Application Guides, BSS Audio, 2010.
Symetrix, Inc., SymNet Network Audio Solutions Brochure, 2008, 32 pgs.
SymNet Network Audio Solutions Brochure, Symetrix, Inc., 2008.
Tan, et al., "Pitch Detection Algorithm: Autocorrelation Method and AMDF," Department of Computer Engineering, Prince of Songkhla University, Jan. 2003, 6 pp.
Tandon, et al., "An Efficient, Low-Complexity, Normalized LMS Algorithm for Echo Cancellation," 2nd Annual IEEE Northeast Workshop on Circuits and Systems, Jun. 2004, pp. 161-164.
Tetelbaum et al., Design and Implementation of a Conference Phone Based on Microphone Array Technology, Proc. Global Signal Processing Conference and Expo (GSPx), Sep. 2004, 6 pgs.
Tiete et al., SoundCompass: A Distributed MEMS Microphone Array-Based Sensor for Sound Source Localization, Sensors, Jan. 23, 2014, pp. 1918-1949.
TOA Corp., Ceiling Mount Microphone AN-9001 Operating Instructions, http://www.toaelectronics.com/media/an9001_mt1e.pdf, 1 pg.
Togami, et al., "Subband Beamformer Combined with Time-Frequency ICA for Extraction of Target Source Under Reverberant Environments," 17th European Signal Processing Conference, Aug. 2009, 5 pp.
U.S. Appl. No. 16/598,918, filed Oct. 10, 2019, 50 pp.
Van Compernolle, Switching Adaptive Filters for Enhancing Noisy and Reverberant Speech from Microphone Array Recordings, Proc. IEEE Int. Conf. on Acoustics, Speech, and Signal Processing, Apr. 1990, pp. 833-836.
Van Trees, Optimum Array Processing: Part IV of Detection, Estimation, and Modulation Theory, 2002, 54 pgs., pp. i-xxv, 90-95, 201-230.
Van Veen et al., Beamforming: A Versatile Approach to Spatial Filtering, IEEE ASSP Magazine, vol. 5, issue 2, Apr. 1988, pp. 4-24.
Vicente, "Adaptive Array Signal Processing Using the Concentric Ring Array and the Spherical Array," Ph.D. Dissertation, University of Missouri, May 2009, 226 pp.
Wang et al., Combining Superdirective Beamforming and Frequency-Domain Blind Source Separation for Highly Reverberant Signals, EURASIP Journal on Audio, Speech, and Music Processing, vol. 2010, pp. 1-13.
Warsitz, et al., "Blind Acoustic Beamforming Based on Generalized Eigenvalue Decomposition," IEEE Transactions on Audio, Speech and Language Processing, vol. 15, No. 5, 2007, 11 pp.
Weinstein, et al., "LOUD: A 1020-Node Microphone Array and Acoustic Beamformer," 14th International Congress on Sound & Vibration, Jul. 2007, 8 pgs.
Weinstein, et al., "LOUD: A1020-Node Modular Microphone Array and Beamformer for Intelligent Computing Spaces," MIT Computer Science and Artifical Intelligence Laboratory, 2004, 18 pp.
Wung, "A System Approach to Multi-Channel Acoustic Echo Cancellation and Residual Echo Suppression for Robust Hands-Free Teleconferencing," Georgia Institute of Technology, May 2015, 167 pp.
XAP Audio Conferencing Brochure, ClearOne Communications, Inc., 2002.
Yamaha Corp., MRX7-D Signal Processor Product Specifications, 2016, 12 pgs.
Yamaha Corp., PJP-100H IP Audio Conference System Owner's Manual, Sep. 2006, 59 pgs.
Yamaha Corp., PJP-EC200 Conference Echo Canceller Brochure, Oct. 2009, 2 pgs.
Yan et al., Convex Optimization Based Time-Domain Broadband Beamforming with Sidelobe Control, Journal of the Acoustical Society of America, vol. 121, No. 1, Jan. 2007, pp. 46-49.
Yensen et al., Synthetic Stereo Acoustic Echo Cancellation Structure with Microphone Array Beamforming for VOIP Conferences, 2000 IEEE International Conference on Acoustics, Speech, and Signal Processing, Jun. 2000, pp. 817-820.
Yermeche, et al., "Real-Time DSP Implementation of a Subband Beamforming Algorithm for Dual Microphone Speech Enhancement," 2007 IEEE International Symposium on Circuits and Systems, 4 pp.
Zavarehei, et al., "Interpolation of Lost Speech Segments Using LP-HNM Model with Codebook Post-Processing," IEEE Transactions on Multimedia, vol. 10, No. 3, Apr. 2008, 10 pp.
Zhang, et al., "F-T-LSTM based Complex Network for Joint Acoustic Echo Cancellation and Speech Enhancement," Audio, Speech and Language Processing Group, Jun. 2021, 5 pp.
Zhang, et al., "Multichannel Acoustic Echo Cancelation in Multiparty Spatial Audio Conferencing with Constrained Kalman Filtering," 11th International Workshop on Acoustic Echo and Noise Control, Sep. 14, 2008, 4 pp.
Zhang, et al., "Selective Frequency Invariant Uniform Circular Broadband Beamformer," EURASIP Journal on Advances in Signal Processing, vol. 2010, pp. 1-11.
Zheng, et al., "Experimental Evaluation of a Nested Microphone Array With Adaptive Noise Cancellers," IEEE Transactions on Instrumentation and Measurement, vol. 53, No. 3, Jun. 2004, 10 pp.

* cited by examiner

HYBRID AUDIO BEAMFORMING SYSTEM

CROSS-REFERENCE TO RELATED APPLICATIONS

This application claims the benefit of U.S. Provisional Patent Application No. 63/142,711, filed Jan. 28, 2021, which is fully incorporated by reference in its entirety herein.

TECHNICAL FIELD

This application generally relates to an audio beamforming system. In particular, this application relates to a hybrid audio beamforming system having narrower beams and improved directivity, through the use of a time domain beamformer for processing upper frequency band signals of an audio signal and a frequency domain beamformer for processing lower frequency band signals of the audio signal.

BACKGROUND

Conferencing environments, such as conference rooms, boardrooms, video conferencing applications, and the like, can involve the use of microphones for capturing sound from various audio sources active in such environments. Such audio sources may include humans speaking, for example. The captured sound may be disseminated to a local audience in the environment through amplified speakers (for sound reinforcement), and/or to others remote from the environment (such as via a telecast and/or a webcast). The types of microphones and their placement in a particular environment may depend on the locations of the audio sources, physical space requirements, aesthetics, room layout, and/or other considerations. For example, in some environments, the microphones may be placed on a table or lectern near the audio sources. In other environments, the microphones may be mounted overhead to capture the sound from the entire room, for example. Accordingly, microphones are available in a variety of sizes, form factors, mounting options, and wiring options to suit the needs of particular environments.

Traditional microphones typically have fixed polar patterns and few manually selectable settings. To capture sound in a conferencing environment, many traditional microphones can be used at once to capture the audio sources within the environment. However, traditional microphones tend to capture unwanted audio as well, such as room noise, echoes, reverberations, and other undesirable audio elements. The capturing of these unwanted noises is exacerbated by the use of many microphones.

Array microphones having multiple microphone elements can provide benefits such as steerable coverage or pick up patterns having beams or lobes, which allow the microphones to focus on the desired audio sources and reject unwanted sounds such as room noise. The ability to steer audio pick up patterns provides the benefit of being able to be less precise in microphone placement, and in this way, array microphones are more forgiving. Moreover, array microphones provide the ability to pick up multiple audio sources with one array microphone or unit, again due to the ability to steer the pickup patterns.

Beamforming is used to combine signals from the microphone elements of array microphones in order to achieve a certain pickup pattern having one or more beams or lobes. However, due to longer wavelengths of sound at lower frequencies, the widths of beams generated using typical beamforming algorithms (e.g., delay and sum operating in the time domain) on broadband audio signals can be wider than what is configured or desired. Furthermore, the directionality of the beams may not be optimal when using typical beamforming algorithms on broadband audio signals. The wider beam widths and the non-optimal beam directionality can result in the sensing of undesired audio, reduced performance of the array microphone, and user dissatisfaction with the array microphone. In addition, using frequency domain beamforming across the entire frequency range can be computationally and memory resource intensive.

Accordingly, there is an opportunity for an audio beamforming system that addresses these concerns. More particularly, there is an opportunity for a hybrid audio beamforming system having narrower beams and improved directivity, through the use of a time domain beamformer for processing upper frequency band signals of an audio signal and a frequency domain beamformer for processing lower frequency band signals of the audio signal.

SUMMARY

The invention is intended to solve the above-noted problems by providing audio beamformer systems and methods that are designed to, among other things: (1) provide a time domain beamformer to generate a first beamformed signal based on upper frequency band signals derived from audio signals, and using a time domain beamforming technique; (2) provide a frequency domain beamformer to generate a second beamformed signal based on lower frequency band signals derived from the audio signals, and using a first frequency domain beamforming technique for a first group of the lower frequency band signals and using a second frequency domain beamforming technique for a second group of the lower frequency band signals; (3) output a beamformed output signal based on the first beamformed signal generated by the time domain beamformer and the second beamformed signal generated by the frequency domain beamformer; (4) have an improved width and directionality of the beams, particularly in lower frequencies; and (5) reduce the use of computational and memory resources by avoiding the use of frequency domain beamforming across the entire frequency range.

In an embodiment, a beamforming system includes a first beamformer configured to generate a first beamformed signal based on first frequency band signals derived from a plurality of audio signals, a second beamformer configured to generate a second beamformed signal based on second frequency band signals derived from the plurality of audio signals, and an output generation unit in communication with the first and second beamformers. The first beamformer is configured to process the first frequency band signals using a first beamforming technique, the second beamformer is configured to process the second frequency band signals using a second beamforming technique, and the output generation unit is configured to generate a beamformed output signal based on the first beamformed signal and the second beamformed signal.

In another embodiment, a beamforming system includes a first beamformer configured to generate a first beamformed signal based on upper frequency band signals derived from a plurality of audio signals, a second beamformer configured to generate a second beamformed signal based on lower frequency band signals derived from the plurality of audio signals, and an output generation unit in communication with the first and second beamformers. The first beamformer is configured to process the upper frequency band signals using a time domain beamforming technique, and the second beamformer is configured to process a first group of the lower frequency band signals using a first frequency domain beamforming technique and a second group of the lower frequency band signals using a second frequency domain beamforming technique. The output generation unit is configured to generate a beamformed output signal based on the first beamformed signal and the second beamformed signal.

In a further embodiment, a method includes receiving a plurality of audio signals; generating a first beamformed signal based on upper frequency band signals derived from the plurality of audio signals, using a time domain beamforming technique; generating a second beamformed signal based on lower frequency band signals derived from the plurality of audio signals, using a frequency domain beamforming technique; and generating a beamformed output signal based on the first beamformed signal and the second beamformed signal.

In another embodiment, a beamforming system includes a first beamformer configured to generate a first beamformed signal based on first frequency band signals derived from a plurality of audio signals, a second beamformer configured to generate a second beamformed signal based on second frequency band signals derived from the plurality of audio signals, and an output generation unit in communication with the first and second beamformers. The first beamformer is configured to process the first frequency band signals using a time domain beamforming technique, and the second beamformer is configured to process a first group of the second frequency band signals using a first frequency domain beamforming technique, and a second group of the second frequency band signals using a second frequency domain beamforming technique. The output generation unit is configured to generate a beamformed output signal based on the first beamformed signal and the second beamformed signal.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
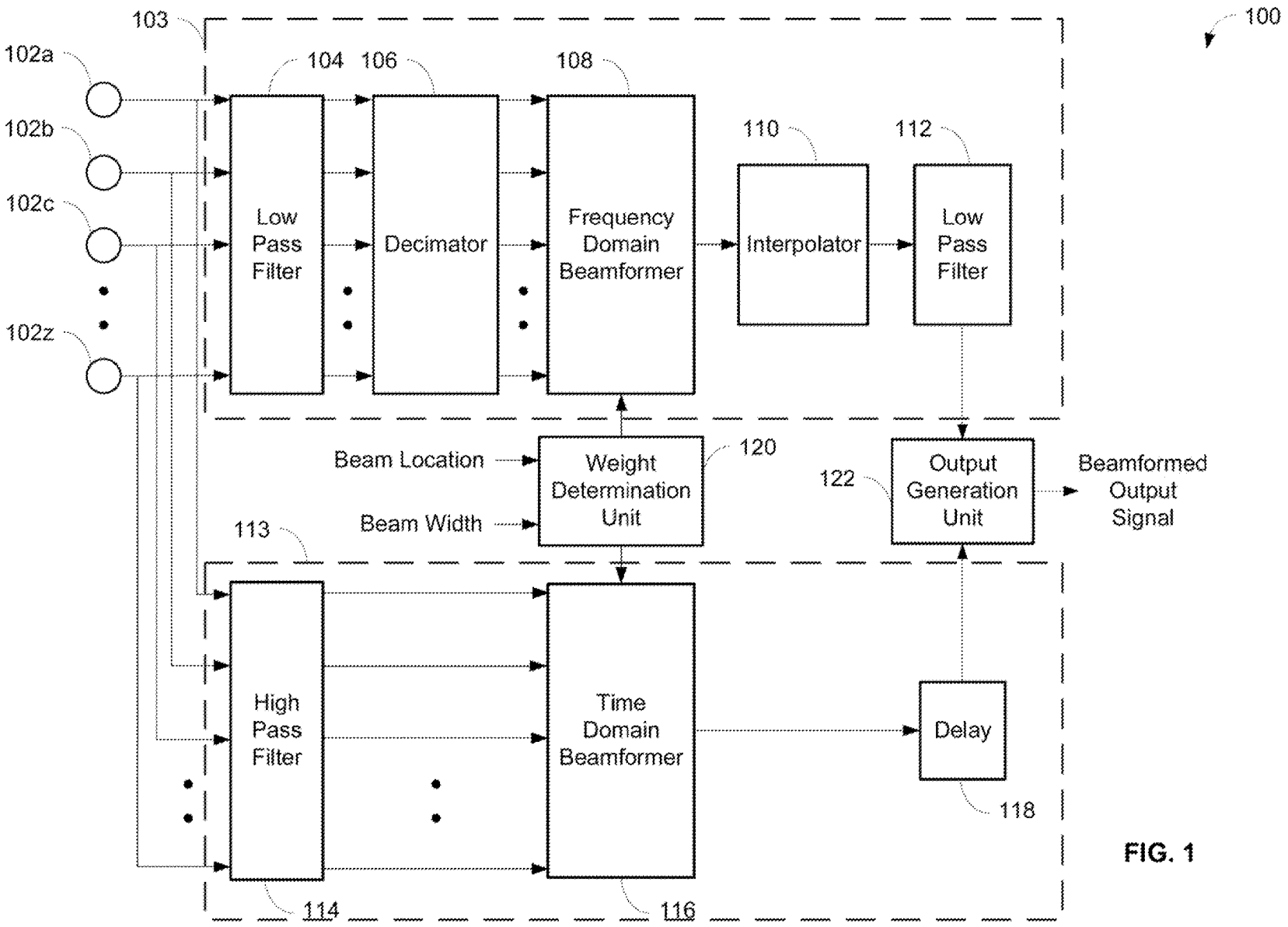
FIG. 1 is a block diagram of a hybrid audio beamforming system for use with an array microphone, in accordance with some embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

The hybrid audio beamforming systems and methods described herein can enable array microphones to have narrower beams, improved beam directionality, and better overall performance across different frequency ranges. The hybrid audio beamforming system may include a time domain beamformer configured to process upper frequency band signals using a time domain beamforming technique, and a frequency domain beamformer configured to process groups of lower frequency band signals using multiple frequency domain beamforming techniques. The upper frequency band signals and the lower frequency band signals may be derived from audio signals, such as audio signals from microphone elements of an array microphone. The hybrid audio beamforming system may generate a beamformed output signal based on the first beamformed signal from the time domain beamformer and the second beamformed signal from the frequency domain beamformer.

The frequency domain beamformer may convert the time domain audio signal into the frequency domain using a transform such as a discrete Fourier Transform (DFT) with a hop size less than the DFT block size. The frequency domain beamformer may utilize a first frequency domain beamforming technique to process a first group of the lower frequency band signals, such as lower frequency components of the lower frequency band signals. The frequency domain beamformer may also utilize a second frequency domain beamforming technique to process a second group of the lower frequency band signals, such as upper frequency components of the lower frequency band signals. By using multiple frequency domain beamforming techniques in the frequency domain beamformer, the frequency domain beamformer may generate narrower beams with improved directionality for audio in lower frequency ranges. The beamformed signal from the frequency domain beamformer may be converted to the time domain such as an inverse DFT, and the converted time domain signal may be further smoothed using the weighted overlap-add (WOLA) method.

As such, combining the time domain beamformer that uses a time domain beamforming technique and the frequency domain beamformer that uses frequency domain beamforming techniques can result in beam widths and directionality that are more optimal over different frequency ranges while using the same sets of microphone elements in an array microphone. In addition, the increased computational and memory resources needed when using frequency domain beamforming across the entire frequency range can be avoided. Latency, computational resources, and the storage of weight coefficients for the beamformers can therefore be minimized through the use of the hybrid audio beamforming systems and methods described herein.

FIG. 1 is a block diagram of a hybrid audio beamforming system 100. The hybrid audio beamforming system 100 may include microphone elements 102*a, b, c, . . . , z* that are included in an array microphone; a lower frequency band signal path 103 that includes a low pass filter 104, a decimator 106, a frequency domain beamformer 108, an interpolator 110, and a low pass filter 112; an upper frequency band signal path 113 that includes a high pass filter 114, a time domain beamformer 116, and a delay element 118; a weight determination unit 120; and an output generation unit 122. Various components included in the hybrid audio beamforming system 100 may be implemented using software executable by a computing device with a processor and memory, and/or by hardware (e.g., discrete logic circuits, application specific integrated circuits (ASIC), programmable gate arrays (PGA), field programmable gate arrays (FPGA), etc.)

The array microphone that includes the microphone elements 102*a, b, c, . . . , z* can detect sounds from audio sources at various frequencies. The array microphone may be utilized in a conference room or boardroom, for example, where the audio sources may be one or more human speakers and/or other desirable sounds. Other sounds may be present in the environment which may be undesirable, such as noise from ventilation, other persons, audio/visual equipment, electronic devices, etc. In a typical situation, the audio sources may be seated in chairs at a table, although other configurations and placements of the audio sources are contemplated and possible.

The array microphone may be placed on a table, lectern, desktop, etc. so that the sound from the audio sources can be detected and captured, such as speech spoken by human speakers. The array microphone may include any number of microphone elements 102*a, b, c, . . . , z*, and be able to form multiple pickup patterns using the hybrid beamforming audio system 100 so that the sound from the audio sources is more consistently detected and captured. The microphone elements 102*a, b, c, . . . , z* may be arranged in any suitable layout, including in concentric rings and/or be harmonically nested. The microphone elements 102*a, b, c, . . . , z* may be arranged to be generally symmetric or may be asymmetric, in embodiments. In further embodiments, the microphone elements 102*a, b, c, . . . , z* may be arranged on a substrate, placed in a frame, or individually suspended, for example. An embodiment of an array microphone is described in commonly assigned U.S. Pat. No. 9,565,493, which is hereby incorporated by reference in its entirety herein.

The microphone elements 102*a, b, c, . . . , z* may each be a MEMS (micro-electrical mechanical system) microphone, in some embodiments. In other embodiments, the microphone elements 102*a, b, c, . . . , z* may be electret condenser microphones, dynamic microphones, ribbon microphones, piezoelectric microphones, and/or other types of microphones. In embodiments, the microphone elements 102*a, b, c, . . . , z* may be unidirectional microphones that are primarily sensitive in one direction. In other embodiments, the microphone elements 102*a, b, c, . . . , z* may have other directionalities or polar patterns, such as cardioid, subcardioid, or omnidirectional.

Each of the microphone elements 102*a, b, c, . . . , z* in the array microphone may detect sound and convert the sound to an audio signal. Components in the array microphone, such as analog to digital converters, processors, and/or other components, may process the audio signals and ultimately generate one or more digital audio output signals. The digital audio output signals may conform to the Dante standard for transmitting audio over Ethernet, in some embodiments, or may conform to another standard. In other embodiments, the microphone elements 102*a, b, c, . . . , z* in the array microphone may output analog audio signals so that other components and devices (e.g., processors, mixers, recorders, amplifiers, etc.) external to the array microphone 100 may process the analog audio signals.

If the microphone elements 102*a, b, c, . . . , z* are only used with a typical beamformer (e.g., a delay and sum beamformer operating in the time domain), then the beam width may be wider than desired and the directivity of the beam may not be optimal, especially at lower frequencies. This may be due to the longer wavelengths of sound at these lower frequencies. Furthermore, beamforming of lower frequencies in the time domain can result in excessive side lobes, relatively high latencies, and/or higher computational load during processing.

However, as described in further detail herein, both the lower frequency band signal path 103 (including the frequency domain beamformer 108) and the upper frequency band signal path 113 (including the time domain beamformer 116) may be in communication with the microphone elements 102*a, b, c, . . . , z*. In particular, the frequency domain beamformer 108 may be used to process lower frequency band signals that are derived from the audio signals of the microphone elements 102*a, b, c, . . . , z*. The lower frequency band signals may be from 0-12 kHz, for example. The time domain beamformer 116 may be used to process upper frequency band signals that are also derived from the audio signals of the microphone elements 102*a, b, c, . . . , z*. The upper frequency band signals may be from 12-24 kHz, for example. As such, using the hybrid audio beamforming system 100 may result in beam widths that are narrower and with improved directionality over different frequencies, including at lower frequencies.

Figure 2:
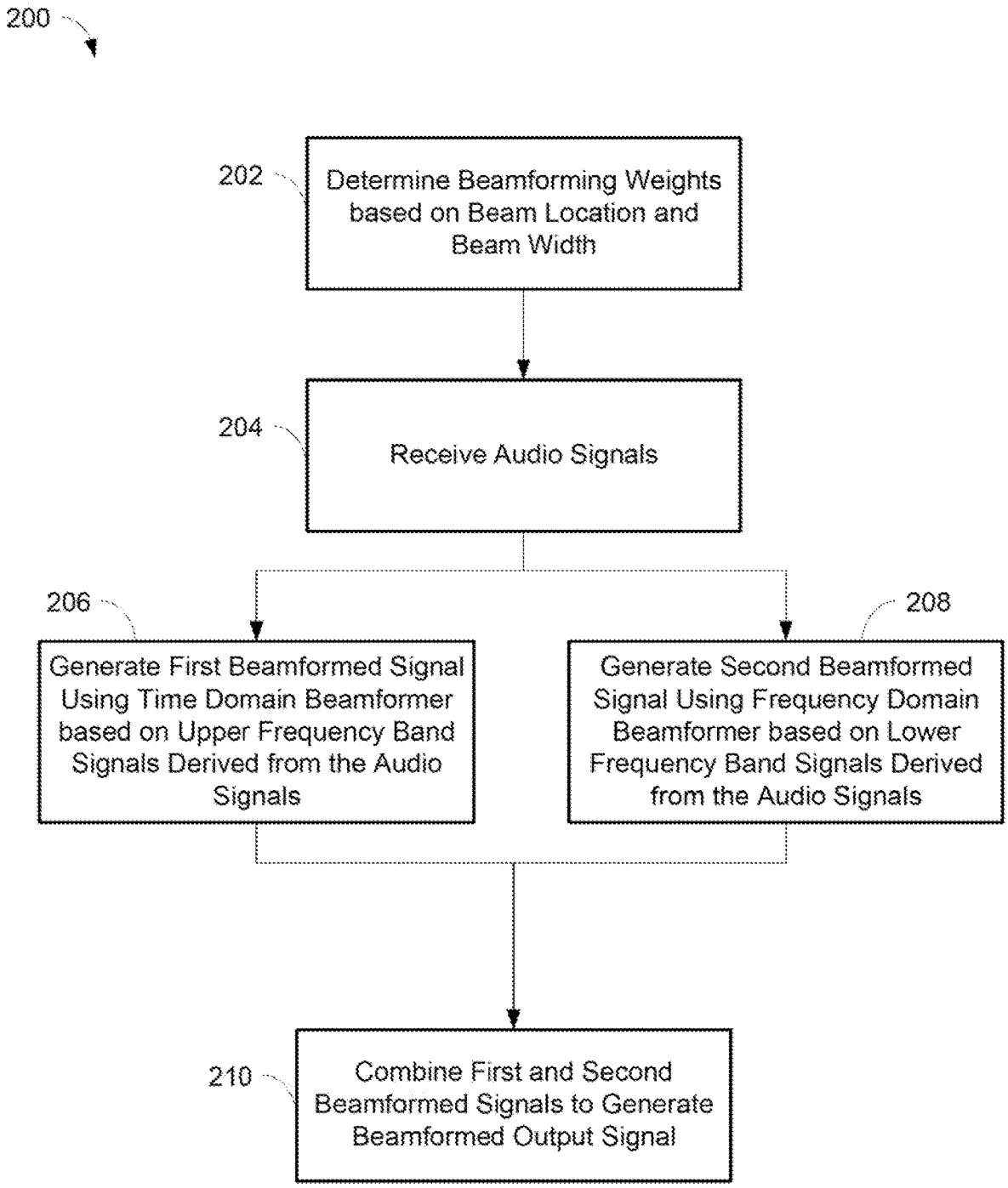
FIG. 2 is a flowchart illustrating operations for the beamforming of audio signals of a plurality of microphones using the hybrid audio beamforming system of FIG. 1, in accordance with some embodiments.

An embodiment of a process 200 for the hybrid beamforming of audio signals in the array microphone is shown in FIG. 2. The process 200 may be utilized to output a beamformed output signal from the array microphone using the hybrid audio beamforming system 100 shown in FIG. 1, where the beamformed output signal has a narrower beam and improved directionality. One or more processors and/or other processing components (e.g., analog to digital converters, encryption chips, etc.) within or external to the system 100 may perform any, some, or all of the steps of the process 200. One or more other types of components (e.g., memory, input and/or output devices, transmitters, receivers, buffers, drivers, discrete components, etc.) may also be utilized in conjunction with the processors and/or other processing components to perform any, some, or all of the steps of the process 200.

At step 202, the weight determination unit 120 may determine the weight coefficients for the frequency domain beamformer 108 (which processes the lower frequency band signals) and the time domain beamformer 116 (which processes the upper frequency band signals), based on a desired location and width of a beam. In some embodiments, the desired location and width of a beam may be determined programmatically or algorithmically using automated decision making schemes, e.g., automatic focusing, placement, and/or deployment of a beam. Embodiments of such schemes are described in commonly assigned U.S. patent application Ser. Nos. 16/826,115 and 16/887,790, which are hereby incorporated by reference in their entirety herein. In other embodiments, the desired location and width of a beam may be configured by a user, e.g., via a user interface on an electronic device in communication with the weight determination unit 120.

The desired location of a beam may be determined or configured as a particular three-dimensional coordinate relative to the location of the array microphone, such as in Cartesian coordinates (i.e., x, y, z), or in spherical coordinates (i.e., radial distance r, polar angle θ (theta), azimuthal angle φ (phi)), for example. The desired width of a beam may be determined or configured in gradations (e.g., narrow, medium, wide, etc.), or as an angle of the field of view (e.g., degrees, change in degrees, percentage change, etc.), for example.

In some embodiments, some or all of the weight coefficients for various locations and widths of the beams may be predetermined and stored in a memory in the weight determination unit 120 or that is in communication with the weight determination unit 120. In other embodiments, some or all of the weight coefficients for various locations and widths of the beams may be calculated on the fly, in order to reduce the amount of memory needed for storage of the weight coefficients. For example, it may be possible to calculate such weight coefficients on the fly for a delay and sum beamforming technique operating in the frequency domain in a relatively efficient and low latency manner. The calculations can take advantage of the constant gain for all the microphone elements 102*a, b, c, . . . , z* and the uniform incremental phase shift amounts.

In embodiments, the weight coefficients for various locations and widths of the beams for certain beamforming techniques (e.g., minimum variance distortionless response operating in the frequency domain) may be generated using static noise covariance to obtain a narrower beam width, or using dynamic noise covariance for improved signal to noise ratio.

Audio signals from the microphone elements 102*a, b, c, . . . , z* may be received at step 204 at the lower frequency band signal path 103 (in embodiments, at the low pass filter 104) and also at the upper frequency band signal path 113 (in embodiments, at the high pass filter 114). At step 206, a first beamformed signal may be generated using the time domain beamformer 116 based on upper frequency band signals derived from the audio signals from the microphone elements 102*a, b, c, . . . , z* received at step 204, and through the use of a time domain beamforming technique. The upper frequency band signals may include middle and higher frequencies, e.g., 12-24 kHz. The time domain beamforming technique used in the time domain beamformer 116 may utilize the weight coefficients determined at step 202. An embodiment of step 206 is described below with respect to FIG. 3.

At step 208, a second beamformed signal may be generated using the frequency domain beamformer 108 based on lower frequency band signals derived from the audio signals from the microphone elements 102*a, b, c, . . . , z* received at step 204, and through the use of frequency domain beamforming techniques on different groups of the lower frequency band signals. The audio signals may be converted from the time domain to the frequency domain in order to produce the lower frequency domain signals utilized in the frequency domain beamformer 108. The lower frequency band signals may include signals with lower frequencies than the upper frequency band signals, e.g., 0-12 kHz. The frequency domain beamforming techniques used in the frequency domain beamformer 108 may utilize the weight coefficients determined at step 202. An embodiment of step 208 is described below with respect to FIG. 4. In embodiments, steps 206 and 208 may be performed substantially at the same time or may be performed at different times.

A beamformed output signal may be generated by the output generation unit 122 at step 210. The beamformed output signal may be generated by combining the first beamformed signal and the second beamformed signal that are generated by the time domain beamformer 116 and the frequency domain beamformer 108, respectively. In embodiments, the first beamformed signal and the second beamformed signal may be combined by being summed together by the output generation unit 122 to generate the beamformed output signal. The beamformed output signal may be a digital signal, such as a signal conforming to the Dante standard for transmitting audio over Ethernet, for example. In embodiments, the beamformed output signal may be output to components or devices (e.g., processors, mixers, recorders, amplifiers, etc.) external to the hybrid audio beamforming system 100 and/or the array microphone.

Figure 3:
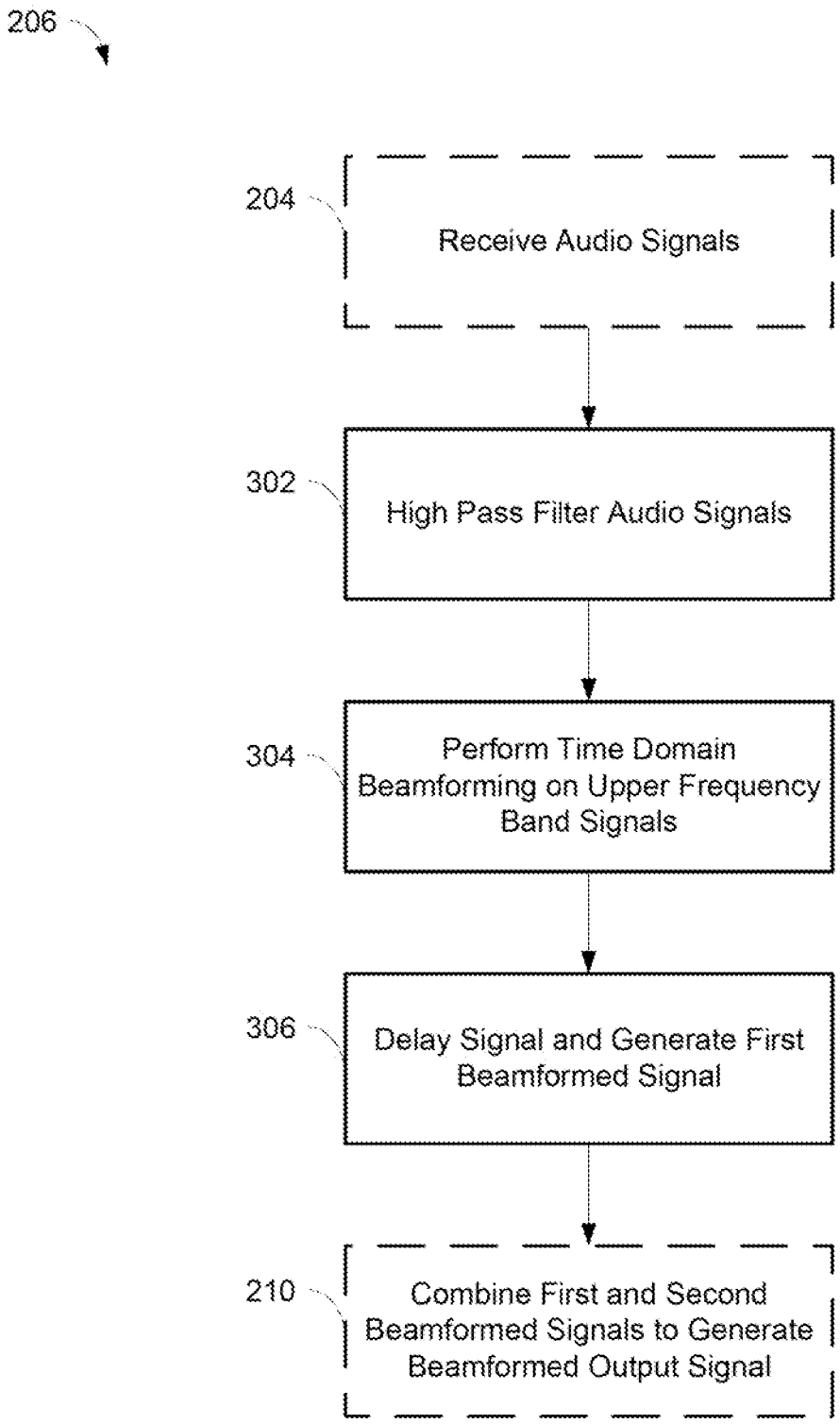
FIG. 3 is a flowchart illustrating operations for the beamforming of upper frequency band signals derived from the audio signals of the plurality of microphones and using a time domain beamformer, in accordance with some embodiments.

FIG. 3 shows an embodiment of a process 206 for the time domain beamforming of upper frequency band signals using the upper frequency band signal path 113 that includes the time domain beamformer 108. The process 206 shown in FIG. 3 may correspond to step 206 of the process 200 shown in FIG. 2. In the process 206 of FIG. 3, the audio signals received at step 204 of the process 200 may be filtered at step 302 by the high pass filter 114. The high pass filter 114 may be configured to pass the audio signals having frequencies in an upper frequency range, e.g., 12-24 kHz. In embodiments, the spectrum response of the high pass filter 114 may be matched to the spectrum response of the low pass filter 104 (of the lower frequency band signal path 103), in order to flatten the spectrum response of the broadband signal, i.e., the beamformed output signal.

At step 304, the upper frequency band signals from the high pass filter 114 may be processed by the time domain beamformer 116 using a time domain beamforming technique. The time domain beamformer 116 may utilize a delay and sum beamformer technique, in embodiments. As described previously, the weight coefficients used by the time domain beamformer 116 may be received from the weight determination unit 120 at step 202, based on the desired location and width of the beam.

At step 306, the signal generated by the time domain beamformer 116 may be delayed by the delay element 118 to generate the first beamformed signal that is provided to the output generation unit 122. The output generation unit 122 can combine the first and second beamformed signals at step 210 of the process 200, as described previously. The delay element 118 may add an appropriate amount of delay to the signal from the time domain beamformer 116 in order to align the signal with the second beamformed signal generated by the lower frequency band signal path 103. This may be due to the lower frequency band signal path 103 having a larger latency due to its additional components (i.e., low pass filters 104, 112, decimator 106, and interpolator 110), as well as due to the frequency domain beamformer 108. Accordingly, the amount of delay added by the delay element 118 may be based on the difference in the latency between the lower frequency band signal path 103 and the upper frequency band signal path 113.

Figure 4:
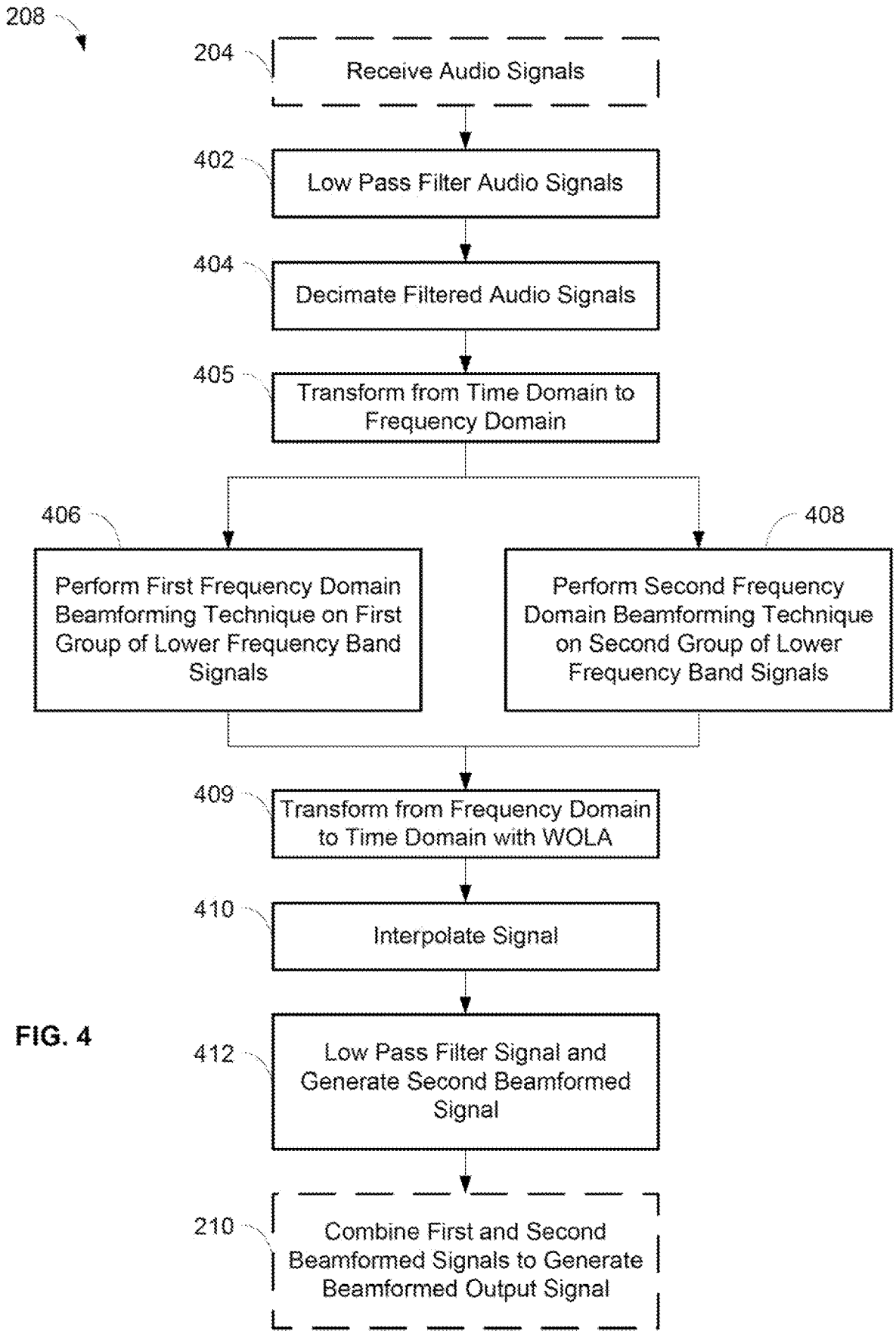
FIG. 4 is a flowchart illustrating operations for the beamforming of lower frequency band signals derived from the audio signals of the plurality of microphones and using a frequency domain beamformer, in accordance with some embodiments.

FIG. 4 shows an embodiment of a process 208 for the frequency domain beamforming of lower frequency band signals using the lower frequency band signal path 103 that includes the frequency domain beamformer 108. The process 208 shown in FIG. 4 may correspond to step 208 of the process 200 shown in FIG. 2. In the process 208 of FIG. 4, the audio signals received at step 204 of the process 200 may be filtered at step 402 by the low pass filter 104. The low pass filter 104 may be configured to pass the audio signals having frequencies in a lower frequency range, e.g., 0-12 kHz.

The filtered signals from the low pass filter 104 may be processed by the decimator 106 to generate the lower frequency band signals for processing by the frequency domain beamformer 108 at step 404. In particular, the decimator 106 may downsample the filtered signals by a particular factor to a lower sampling rate, as compared to the sampling rate of the audio signals received at step 204. The filtered signals may be downsampled in order to simplify the computation and complexity of processing by the frequency domain beamformer 108. In embodiments, the decimator 106 may downsample the filtered signals by a factor of 2 to a 24 kHz sampling rate from the 48 kHz sampling rate of the audio signals. In other embodiments, the decimator 106 may downsample the filtered signals by a different factor to another appropriate sampling rate.

At step 405, the decimated filtered signals may be transformed from the time domain into the frequency domain using a suitable frequency transform, such as a fast Fourier transform, a short-time Fourier transform, a discrete Fourier transform, a discrete cosine transform, or a wavelet transform. The lower frequency band signals may be processed using frequency domain beamforming techniques in order to avoid issues with excessive side lobes and the need to use a high order filter bank that may occur when using time domain beamforming techniques on lower frequency band signals.

At steps 406 and 408, the frequency domain beamformer 108 may process two groups of the lower frequency band signals using differing frequency domain beamforming techniques. While FIG. 4 shows the lower frequency band signals being processed in two groups, it is contemplated and possible for the frequency domain beamformer 108 to process more than two groups of the lower frequency band signals using two or more frequency domain beamforming techniques, in embodiments.

In embodiments, the lower frequency band signals in the frequency domain may be transformed using a weighted overlap-add (WOLA) methodology. The WOLA methodology may break up the lower frequency band signals into overlapping frames having a particular size, in order to reduce the artifacts at the boundaries between the frames. The frames may be transformed into frequency bins using a frequency transform. The frequency bins may be divided into a first group (e.g., lower frequency components of the lower frequency band signals) and into a second group (e.g., upper frequency components of the lower frequency band signals).

In embodiments, the frame size of the WOLA methodology may be configurable to allow a tradeoff between (1) latency in the lower frequency band signal path 103, and (2) computational resources and memory usage. In particular, if the frame size is smaller than or equal to a block size of the frequency transform, then the latency of the lower frequency band signal path 103 may be reduced while utilizing relatively higher computational resources and memory. The block size of the FFT transform and the frame size may be expressed in a number of samples. For example, the latency of the lower frequency band signal path 103 when the block size of the FFT transform is 256 and the frame size is 256 may be greater than the latency of the lower frequency band signal path 103 when the frame size is 128 or 192 (and when the block size of the FFT transform remains at 256), using a zero padding method to make up a whole block of data for the FFT.

At step 406, the first group of the lower frequency band signals may be processed by the frequency domain beamformer 108 using a first frequency domain beamforming technique. In embodiments, the first group may be lower frequency components of the lower frequency band signals, and the first frequency domain beamforming technique may be a superdirective beamforming technique, such as a minimum variance distortionless response (MVDR) beamforming technique. In other embodiments, the first frequency domain beamforming technique may be another appropriate superdirective beamforming technique. The frequency range of the lower frequency components of the lower frequency band signals may be dependent on the physical aperture size of the microphone array the beamformer is being used with, such as the frequencies corresponding to below the aperture size. For example, in embodiments, the lower frequency components of the lower frequency band signals may be in the range of approximately 0-1 kHz or approximately 0-2 kHz. As described previously, the weight coefficients used by the first frequency domain beamforming technique in the frequency domain beamformer 116 may be received from the weight determination unit 120 at step 202, based on the desired location and width of the beam.

At step 408, the second group of the lower frequency band signals may be processed by the frequency domain beamformer 108 using a second frequency domain beamforming technique. In embodiments, the second group may be upper frequency components of the lower frequency band signals, and the second frequency domain beamforming technique may be delay and sum beamforming technique. In other embodiments, the second frequency domain beamforming technique may be another appropriate beamforming technique. The frequency range of the upper frequency components of the lower frequency band signals may also be dependent on the physical aperture size of the microphone array the beamformer is being used with, such as the frequencies corresponding one to two octaves above the aperture size. For example, in embodiments, the upper frequency components of the lower frequency band signals may be in the range of approximately 1 kHz or 2 kHz and above. As described previously, the weight coefficients used by the second frequency domain beamforming technique in the frequency domain beamformer 116 may be received from the weight determination unit 120 at step 202, based on the desired location and width of the beam. In embodiments, steps 406 and 408 may be performed substantially at the same time or may be performed at different times.

At step 409, the signal generated by the frequency domain beamformer 108 (that is based on the first and second frequency beamforming techniques) may be transformed from the frequency domain into the time domain using a suitable inverse frequency transform, such as an inverse fast Fourier transform, an inverse short-time Fourier transform, an inverse discrete Fourier transform, an inverse discrete cosine transform, or an inverse wavelet transform. In embodiments, the transformation of the signal from the frequency domain to the time domain may use the WOLA methodology, as previously described.

At step 410, the transformed signal (based on the signal generated by the frequency domain beamformer 108) may be processed by the interpolator 110. In particular, the interpolator 110 may upsample the signal generated by the frequency domain beamformer 108 by a particular factor to a higher sampling rate. In embodiments, the interpolator 110 may upsample the signal by a factor of 2 to a 48 kHz sampling rate. In other embodiments, the interpolator 110 may upsample the signal by a different factor to another appropriate sampling rate.

The low pass filter 122 may filter the upsampled signal from the interpolator 110 at step 412, and generate the second beamformed signal that is provided to the output generation unit 122. The output generation unit 122 can combine the first and second beamformed signals at step 210 of the process 200, as described previously. The low pass filter 122 may be configured to pass components of the upsampled signal having frequencies in a lower frequency range, e.g., 0-12 kHz.

It should be noted that while FIGS. 2-4 describe that the audio signals may be divided for processing into the groups of upper frequency band signals, lower frequency components of the lower frequency band signals, and upper frequency components of the lower frequency band signals, it is contemplated and possible that the audio signal may be divided into groups for processing based on any suitable frequency ranges. Moreover, any of the groups may be processed by the superdirective beamforming technique in the frequency domain, the delay and sum beamforming technique in the frequency domain, and/or the delay and sum beamforming technique in the time domain, as appropriate.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A beamforming system, comprising:

a first beamformer configured to generate a first beamformed signal based on first frequency band signals derived from a plurality of audio signals, wherein the first beamformer is configured to process the first frequency band signals using a first beamforming technique comprising a delay and sum beamforming technique preformed in the time domain;

a second beamformer configured to generate a second beamformed signal based on second frequency band signals derived from the plurality of audio signals, wherein the second beamformer is configured to process the second frequency band signals using a second beamforming technique, wherein the second frequency band signals comprise a first group and a second group, and wherein the second beamformer is further configured to process the first group using a superdirective beamforming technique performed in the frequency domain, and process the second group using a delay and sum beamforming technique in the frequency domain; and an output generation unit in communication with the first and second beamformers, the output generation unit configured to generate a beamformed output signal based on the first beamformed signal and the second beamformed signal.

2. The beamforming system of claim 1, wherein the first beamforming technique comprises a time domain beamforming technique and the second beamforming technique comprises a frequency domain beamforming technique.

3. The beamforming system of claim 1, wherein the second beamforming technique comprises a first frequency domain beamforming technique and a second frequency domain beamforming technique; and wherein the second beamformer is further configured to process the first group using the first frequency domain beamforming technique and process the second group using the second frequency domain beamforming technique.

4. The beamforming system of claim 3, wherein the first and second frequency domain beamforming techniques are based on a weighted overlap-add (WOLA) methodology with a frame size that is smaller than or equal to a block size of a frequency domain transform.

5. The beamforming system of claim 4, wherein the frame size is configurable.

6. The beamforming system of claim 3, further comprising an interpolator configured to generate the second beamformed signal based on a signal generated by the first and second frequency domain beamforming techniques.

7. The beamforming system of claim 6, wherein the interpolator comprises a low pass filter configured to filter the signal generated by the first and second frequency domain beamforming techniques into a filtered signal, and the interpolator is further configured to convert the filtered signal into the second beamformed signal.

8. The beamforming system of claim wherein the superdirective beamforming technique comprises a minimum variance distortionless response (MVDR) beamforming technique performed in the frequency domain.

9. The beamforming system of claim 1, wherein:

the first frequency band signals comprise upper frequency band signals;

the second frequency band signals comprise lower frequency band signals;

the first group of the lower frequency band signals comprises lower frequency components of the lower frequency band signals; and the second group of the lower frequency band signals comprises upper frequency components of the lower frequency band signals.

10. The beamforming system of claim 1, wherein the first frequency band signals comprise upper frequency band signals and the second frequency band signals comprise lower frequency band signals.

11. The beamforming system of claim 1, further comprising a decimator configured to convert the plurality of audio signals into the second frequency band signals.

12. The beamforming system of claim 11, wherein the decimator comprises a low pass filter configured to filter the plurality of audio signals into filtered audio signals, and the decimator is further configured to convert the filtered audio signals into the second frequency band signals.

13. A method, comprising:

receiving a plurality of audio signals;

generating a first beamformed signal based on first frequency band signals derived from the plurality of audio signals, using a first beamforming technique;

generating a second beamformed signal based on second frequency band signals derived from the plurality of audio signals, using a second beamforming technique, wherein the second frequency band signals comprises a first group and a second group, and wherein the second beamforming technique comprises a first frequency domain beamforming technique and a second frequency domain beamforming technique that are each based on a weighted overlay-add (WOLA) methodology with a frame size that is smaller than or equal to a block size of a frequency domain transform; and generating a beamformed output signal based on the first beamformed signal and the second beamformed signal, comprising processing the first group using the first frequency domain beamforming technique and processing the second group using the second frequency domain beamforming technique.

14. The method of claim 13, wherein the first beamforming technique comprises a time domain beamforming technique and the second beamforming technique comprises a frequency domain beamforming technique.

15. The method of claim 13, wherein the frame size is configurable.

16. The method of claim 13, wherein generating the second beamformed signal comprises interpolating a signal generated by the first and second frequency domain beamforming techniques to generate the second beamformed signal.

17. The method of claim 16, wherein interpolating the signal comprises:

low pass filtering the signal generated by the first and second frequency domain beamforming techniques into a filtered signal; and converting the filtered signal into the second beamformed signal.

18. The method of claim 13 wherein the first beamforming technique comprises a delay and sum beamforming technique performed in the time domain; and wherein generating the second beamformed signal comprises processing the first group using a superdirective beamforming technique performed in the frequency domain, and processing the second group using a delay and sum beamforming technique in the frequency domain.

19. The method of claim 18, wherein the superdirective beamforming technique comprises a minimum variance distortionless response (MVDR) beamforming technique performed in the frequency domain.

20. The method of claim 18, wherein:

the first frequency band signals comprise upper frequency band signals;

the second frequency band signals comprise lower frequency band signals;

the first group of the lower frequency band signals comprises lower frequency components of the lower frequency band signals; and the second group of the lower frequency band signals comprises upper frequency components of the lower frequency band signals.

21. The method of claim 13, wherein the first frequency band signals comprise upper frequency band signals and the second frequency band signals comprise lower frequency band signals.

22. The method of claim 13, further comprising decimating the plurality of audio signals into the second frequency band signals.

23. The method of claim 22, wherein decimating the plurality of audio signals comprises:

low pass filtering the plurality of audio signals into filtered audio signals; and converting the filtered audio signals into the second frequency band signals.

24. An array microphone, comprising:

a plurality of microphone elements each configured to generate one of a plurality of audio signals; and a beamformer configured to generate a beamformed output signal based on the plurality of audio signals, wherein the beamformer comprises a plurality of beamformers each configured to process first and second frequency band signals using a different beamforming technique, and wherein the first and second frequency band signals are derived from the plurality of audio signals;

wherein a first beamformer of the plurality of beamformers is configured to process the first frequency band signals using a delay and sum beamforming technique in the time domain; and wherein a second beamformer of the plurality of beamformers is configured to process a first group of the second frequency band signals using a superdirective beamforming technique preformed in the frequency domain, and process a second group of the second frequency band signals using a delay and sum beamforming technique in the frequency domain.

25. The array microphone of claim 24, wherein the superdirective beamforming technique and the delay and sum beamforming technique of the second beamformer are based on a weighted overlap-add (WOLA) methodology with a frame size that is smaller than or equal to a block size of a frequency domain transform.

26. The array microphone of claim 24, wherein:

the first frequency band signals comprise upper frequency band signals; and the second frequency band signals comprise lower frequency band signals.

27. The array microphone of claim 26, where:

the first group of the lower frequency band signals comprises lower frequency components of the lower frequency band signals; and the second group of the lower frequency band signals comprises upper frequency components of the lower frequency band signals.

* * * * *